US010381794B2

(12) United States Patent
Saito

(10) Patent No.: US 10,381,794 B2
(45) Date of Patent: Aug. 13, 2019

(54) TERMINAL-EQUIPPED ELECTRIC WIRE, TERMINAL CRIMPING APPARATUS, AND METHOD OF MANUFACTURING TERMINAL-EQUIPPED ELECTRIC WIRE

(71) Applicant: Yazaki Corporation, Tokyo (JP)

(72) Inventor: Hideki Saito, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/029,718

(22) Filed: Jul. 9, 2018

(65) Prior Publication Data

US 2019/0027883 A1 Jan. 24, 2019

(30) Foreign Application Priority Data

Jul. 21, 2017 (JP) ..... 2017-141639

(51) Int. Cl.

| | |
|---|---|
| ***H01R 43/048*** | (2006.01) |
| ***H01R 4/18*** | (2006.01) |
| ***H01R 43/058*** | (2006.01) |
| *H01R 13/52* | (2006.01) |

(52) U.S. Cl.

CPC ..... *H01R 43/048* (2013.01); *H01R 4/185* (2013.01); *H01R 43/058* (2013.01); *H01R 4/188* (2013.01); *H01R 13/5205* (2013.01)

(58) Field of Classification Search

CPC ..... H01R 43/048; H01R 43/0488; H01R 43/058; H01R 4/184; H01R 4/185; H01R 4/188

See application file for complete search history.

(56) References Cited

U.S. PATENT DOCUMENTS

| | | | | |
|---|---|---|---|---|
| 8,974,258 | B2 * | 3/2015 | Mitose | H01R 4/184 439/877 |
| 9,755,327 | B2 | 9/2017 | Aoki et al. | |
| 2017/0331202 | A1 | 11/2017 | Aoki et al. | |

FOREIGN PATENT DOCUMENTS

| | | |
|---|---|---|
| JP | 2010-015915 A | 1/2010 |
| JP | 2015-179635 A | 10/2015 |

* cited by examiner

*Primary Examiner* — Ross N Gushi
(74) *Attorney, Agent, or Firm* — Kenealy Vaidya LLP

(57) ABSTRACT

An electric wire connection portion includes a second core wire crimping portion) in which a pair of barrel pieces is wound around a core wire while widening a distance with respect to the bottom in a sandwiching direction of the core wire as being directed from a first core wire crimping portion side to the sheath crimping portion side. A boundary crimping area Tc arranged at a boundary part between a second core wire crimping portion and the sheath crimping portion includes a plurality of coupling crimping portions each of which connect two crimping portions among crimping portions having different angles with respect to a drawing direction of the electric wire from the crimp terminal between the second core wire crimping portion side and the sheath crimping portion side in at least an overlapping area.

6 Claims, 19 Drawing Sheets

TERMINAL-EQUIPPED ELECTRIC WIRE, TERMINAL CRIMPING APPARATUS, AND METHOD OF MANUFACTURING TERMINAL-EQUIPPED ELECTRIC WIRE

CROSS-REFERENCE TO RELATED APPLICATION(S)

The present application claims priority to and incorporates by reference the entire contents of Japanese Patent Application No. 2017-141639 filed in Japan on Jul. 21, 2017.

BACKGROUND OF THE INVENTION

1. Field of the Invention

The present invention relates to a terminal-equipped electric wire, a terminal crimping apparatus, and a method of manufacturing a terminal-equipped electric wire.

2. Description of the Related Art

Conventionally, a crimp terminal including an electric wire connection portion to be electrically connected to an electric wire has been known. The electric wire connection portion is partitioned into a bottom and two barrel pieces at both ends of the bottom, and encloses the electric wire with the two barrel pieces while being sandwiched between a first mold and a second mold approaching each other, thereby being crimped onto the electric wire. Upon crimping, the electric wire connection portion is caulked to the electric wire in a state where the bottom is supported by a support surface of the first mold and the two barrel pieces are pressed by a pressing surface of the second mold. The crimp terminal and the electric wire become the terminal-equipped electric wire by finishing the crimping processing. In the terminal-equipped electric wire, an electric wire is drawn out from an end of the electric wire connection portion. This type of terminal-equipped electric wire is disclosed, for example, in Japanese Patent Application No. 2015-179635 and Japanese Patent Application No. 2010-15915.

Meanwhile, the electric wire connection portion has a core wire crimping portion crimped to a bare core wire at the end of the electric wire and a sheath crimping portion crimped to a sheath at the end of the electric wire. In this electric wire connection portion, the pair of barrel pieces is largely crushed by the core wire crimping portion rather than the sheath crimping portion due to a difference in diameter of the electric wire depending on presence or absence of the sheath. Accordingly, in the core wire crimping portion, a distance between the bottom and the pair of barrel pieces is widened on the sheath crimping portion side more than on a distal end side of the core wire to be greatly crushed to such a large extent as being directed toward the sheath crimping portion side, Thus, the outer barrel piece is not wound in close contact with the inner barrel piece at a boundary part between the sheath crimping portion side of the core wire crimping portion and the sheath crimping portion having different angles, so that there is a possibility that a gap is generated between the respective barrel pieces. Therefore, a terminal-equipped electric wire, a terminal crimping apparatus, and a method of manufacturing a terminal-equipped electric wire of the related art have room for improvement in terms of improving sealing performance.

SUMMARY OF THE INVENTION

Therefore, a purpose of the present invention is to provide a terminal-equipped electric wire, a terminal crimping apparatus, and a method of manufacturing a terminal-equipped electric wire that can improve sealing performance.

According to one aspect of the present invention, a terminal-equipped electric wire includes an electric wire having a core wire bare at an end thereof, and a crimp terminal physically and electrically connected to the core wire by being crimped to the end of the electric wire. The crimp terminal includes an electric wire connection portion in which a pair of barrel pieces is wound around the end of the electric wire placed on a bottom thereof to overlap each other, the electric wire connection portion includes a core wire crimping portion in which the bottom and the pair of barrel pieces are crimped to the core wire at the end of the electric wire, and a sheath crimping portion in which the bottom and the pair of barrel pieces are crimped to a sheath at the end of the electric wire, the electric wire connection portion is crimped to the end of the electric wire in a state where a distance between the bottom and the pair of barrel pieces in a sandwiching direction of the sheath in the sheath crimping portion is wider than a distance between the bottom and the pair of barrel pieces in a sandwiching direction of the core wire in the core wire crimping portion, the core wire crimping portion includes a first core wire crimping portion crimped to a distal end side of the core wire, and a second core wire crimping portion in which the pair of barrel pieces is wound around the core wire while widening the distance with respect to the bottom in the sandwiching direction of the core wire as being directed from the first core wire crimping portion side to the sheath crimping portion side, between the first core wire crimping portion and the sheath crimping portion, the core wire crimping portion and the sheath crimping portion have an overlapping area in which one of the barrel pieces and the other barrel piece overlap each other, and a boundary crimping area arranged at a boundary part between the second core wire crimping portion and the sheath crimping portion includes a plurality of coupling crimping portions, which connect two crimping portions having different angles with respect to a drawing direction of the electric wire from the crimp terminal between the second core wire crimping portion side and the sheath crimping portion side, in at least the overlapping area.

According to another aspect of the present invention, in the terminal-equipped electric wire, the coupling crimping portion is formed in an arc shape that is gradually changed from the one of the crimping portions to the other crimping portion.

According to still another aspect of the present invention, a terminal crimping apparatus includes a first mold that supports a bottom of a crimp terminal having the bottom and a pair of barrel pieces with a support surface, and a second mold that winds the pair of barrel pieces around an end of an electric wire to overlap each other while shortening a distance with respect to the first mold in a state where the end of the electric wire is inserted into a space surrounded by the bottom and the pair of barrel pieces. The second mold includes a core wire pressing portion that crimps the pair of barrel pieces to a core wire bare at the end of the electric wire, and a sheath pressing portion that crimps the pair of barrel pieces to a sheath at the end of the electric wire, the core wire pressing portion and the sheath pressing portion are arranged such that a distance between the core pressing portion and the support surface in a relative movement direction between the first mold and the second mold is narrower than a distance between the sheath pressing portion and the support surface in the relative movement direction, the core wire pressing portion includes a first core wire pressing portion that crimps the pair of barrel pieces to a distal end side of the core wire, and a second core wire pressing portion that crimps the pair of barrel pieces to the core wire while widening a distance between the bottom and the pair of barrel pieces in a sandwiching direction of the core wire as being directed from the first core wire pressing portion side to the sheath pressing portion side, between the first core wire pressing portion and the sheath pressing portion, the core wire pressing portion and the sheath pressing portion have a joining pressing area to form an overlapping area in which one of the barrel pieces and the other barrel piece overlap each other, and a boundary pressing area arranged at a boundary part between the second core wire pressing portion and the sheath pressing portion includes a plurality of coupling pressing portions, which connect two pressing portions having different angles with respect to a drawing direction of the electric wire from the crimp terminal between the second core pressing portion side and the sheath pressing portion side, in at least the joining pressing area.

According to still another aspect of the present invention, a method of manufacturing a terminal-equipped electric wire includes a terminal support step of supporting a bottom of a crimp terminal having the bottom and a pair of barrel pieces with a support surface of a first mold, and a crimping step of winding the pair of barrel pieces around an end of an electric wire to overlap each other while shortening a distance between the first mold and a second mold in a state where the end of the electric wire is inserted into a space surrounded by the bottom and the pair of barrel pieces to form a core wire crimping portion crimped to the core wire bare at the end of the electric wire and a sheath crimping portion crimped to a sheath at the end of the electric wire. In the crimping step, the pair of barrel pieces is crimped to a distal end side of the core wire at the end of the electric wire by a first core wire pressing portion of the second mold arranged to oppose the support surface, the pair of barrel pieces is crimped to the sheath at the end of the electric wire by a sheath pressing portion of the second mold arranged to oppose the support surface, and the pair of barrel pieces is crimped to the core wire while widening a distance between the bottom and the pair of barrel pieces in a sandwiching direction of the core wire as being directed from the first core wire pressing portion side to the sheath pressing portion side by a second core wire pressing portion of the second mold arranged to oppose the support surface between the first core wire pressing portion and the sheath pressing portion, thereby forming an overlapping area in which one of the barrel pieces and the other barrel piece overlap each other, and in the crimping step, the pair of barrel pieces is crimped to the end of the electric wire by a plurality of pressing portions, provided in at least a joining pressing area to form the overlapping area in a boundary pressing area arranged at a boundary part between the second core wire pressing portion and the sheath pressing portion, that is, coupling pressing portions, which connect two pressing portions having different angles with respect to a drawing direction of the electric wire from the crimp terminal between the second core wire pressing portion side and the sheath pressing portion side, when crimping the pair of barrel pieces by the first core wire pressing portion, the sheath pressing portion, and the second core wire pressing portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, embodiments of a terminal-equipped electric wire, a terminal crimping apparatus, and a method of manufacturing a terminal-equipped electric wire according to the present invention will be described in detail with reference to the drawings. Incidentally, the invention is not limited by the embodiments.

Embodiment

One of the embodiments of the terminal-equipped electric wire, the terminal crimping apparatus, and the method of manufacturing a terminal-equipped electric wire according to the present invention will be described with reference to FIGS. 1 to 22.

Figure 1:
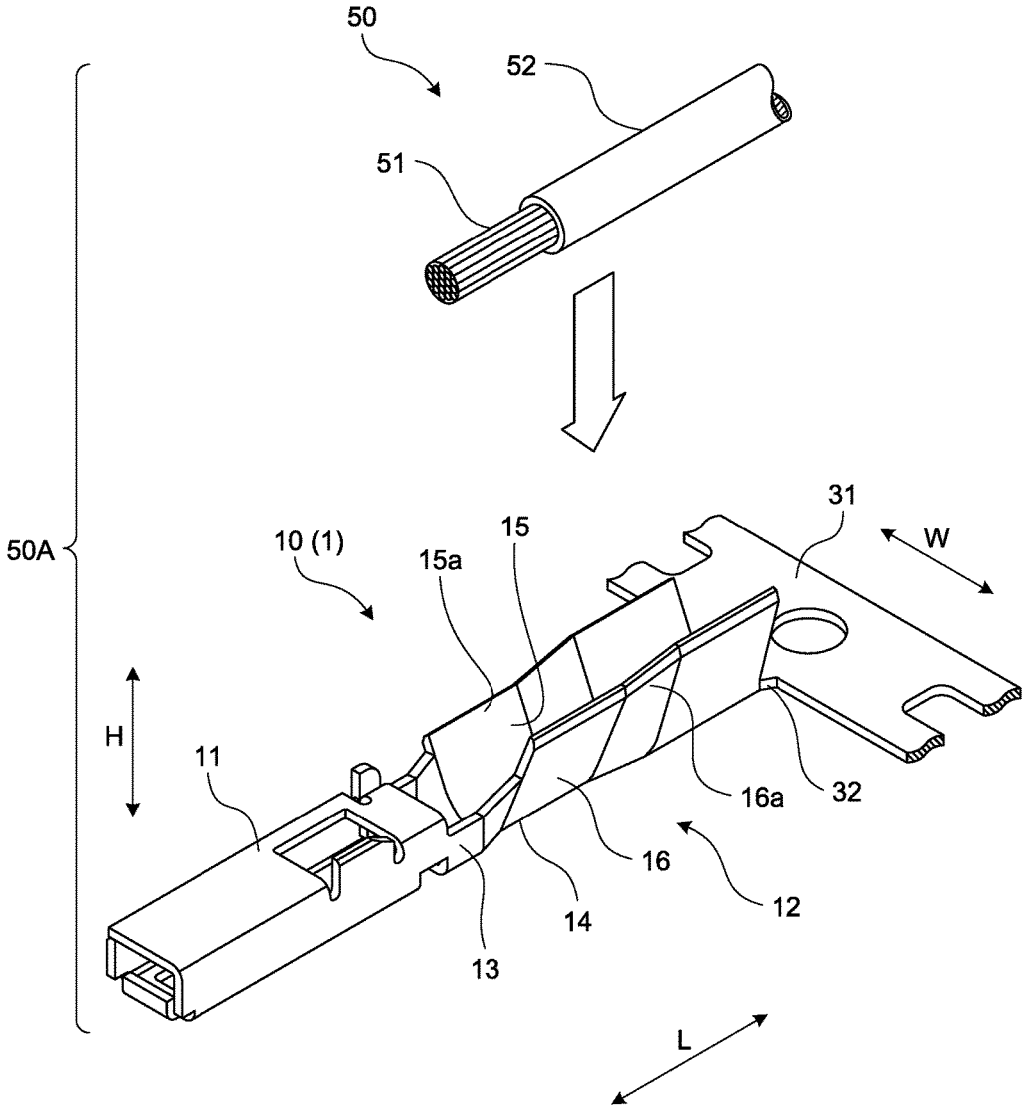
FIG. 1 is a perspective view illustrating a terminal-equipped electric wire before completion of crimping according to an embodiment.

Reference numeral 1 in FIGS. 1 to 7 represents a crimp terminal according to the present embodiment. The crimp terminal 1 is electrically connected to an electric wire 50 (FIGS. 1, 3, and 4), and is electrically connected to a counterpart terminal (not illustrated) in the state of being integrated with the electric wire 50. Here, a core wire 51 is bare at an end of the electric wire 50 (FIG. 1). In order to expose the core wire 51 by a predetermined length, a sheath 52 at the end of the electric wire 50 is peeled off and removed, for example, by a length corresponding to the predetermined length. The core wire 51 may be an aggregate of a plurality of strands or may be a single wire such as a coaxial cable. As being crimped to the end of the electric wire 50, the crimp terminal 1 is physically and electrically connected to the bare core wire 51. The connection between the crimp terminal 1 and the end of the electric wire 50 is obtained by crimping processing between support portions (a first support surface 112$A_1$ and a second support surface 112$B_1$) of a first mold 112 and pressing portions (a core wire pressing portion 113$A_1$ and a sheath pressing portion 113$B_1$) of a second mold 113 to be described later. Hereinafter, a coupler of the crimp terminal 1 and the electric wire 50 illustrated in FIGS. 3 and 4 will be referred to as a "terminal-equipped electric wire 50A".

Figure 6:
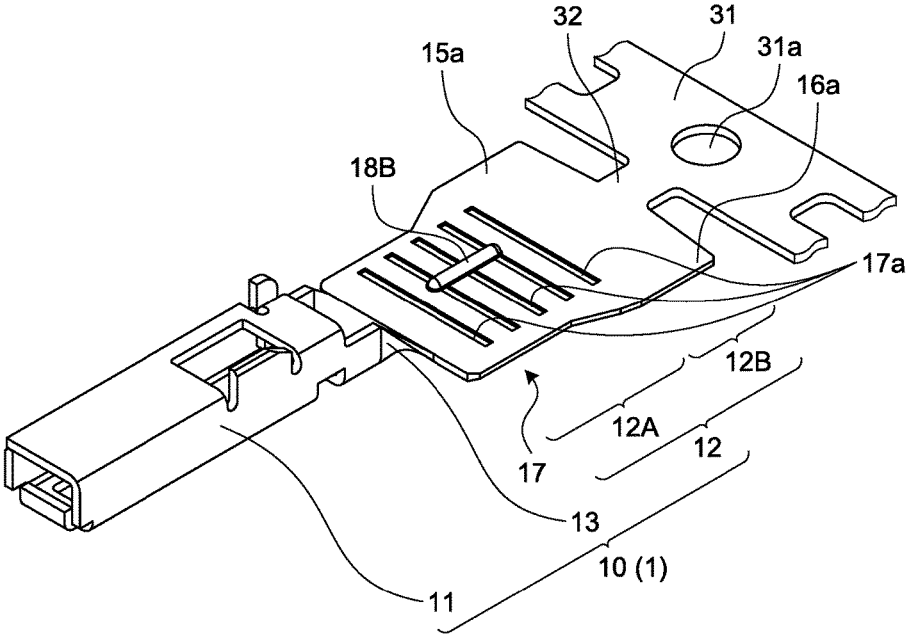
FIG. 6 is a perspective view illustrating the crimp terminal before the electric wire connection portion is formed in the U-shape.
Figure 7:
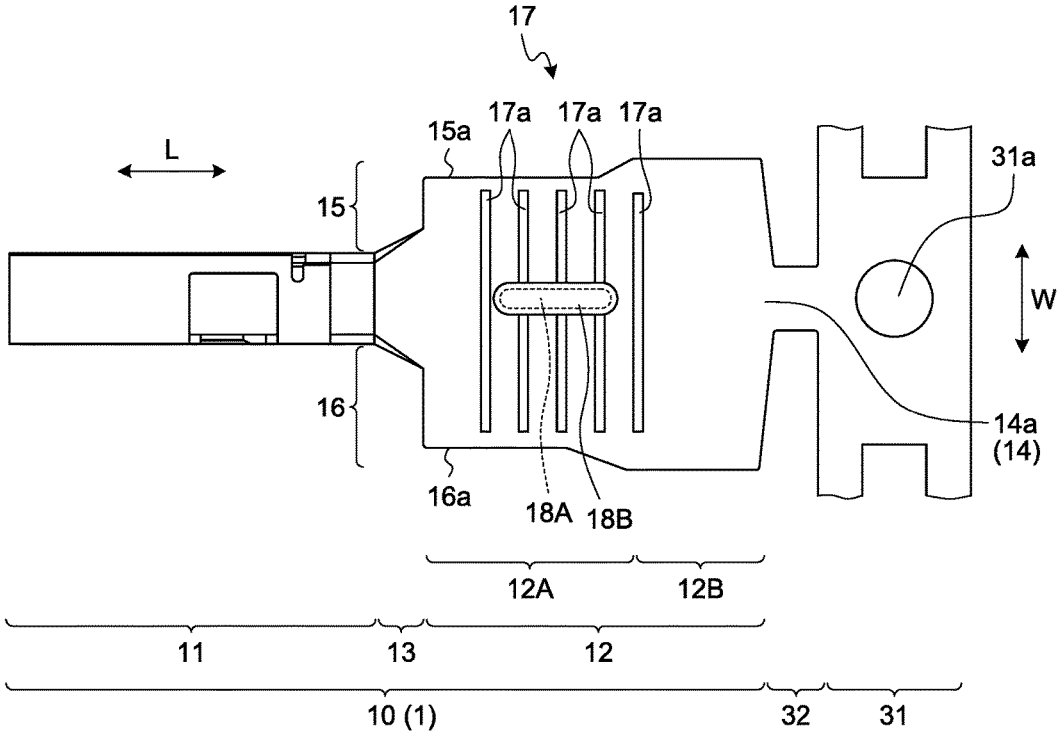
FIG. 7 is a top view illustrating the crimp terminal before the electric wire connection portion is formed in the U-shape.
Figure 8:
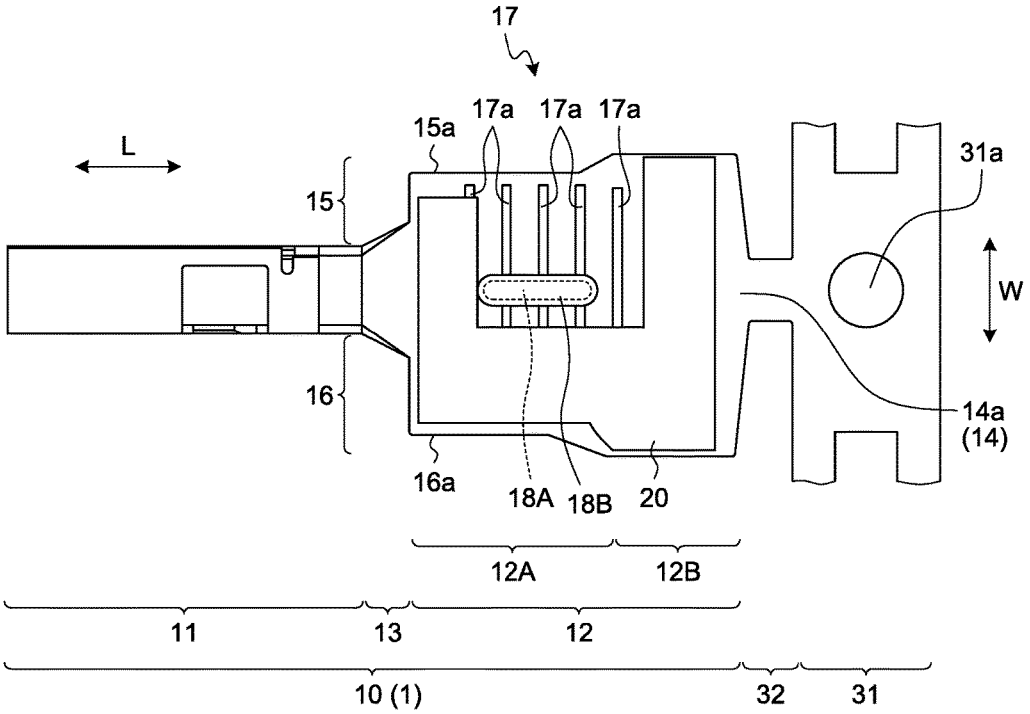
FIG. 8 is a top view illustrating another aspect of the crimp terminal before the electric wire connection portion is formed in the U-shape.
Figure 9:
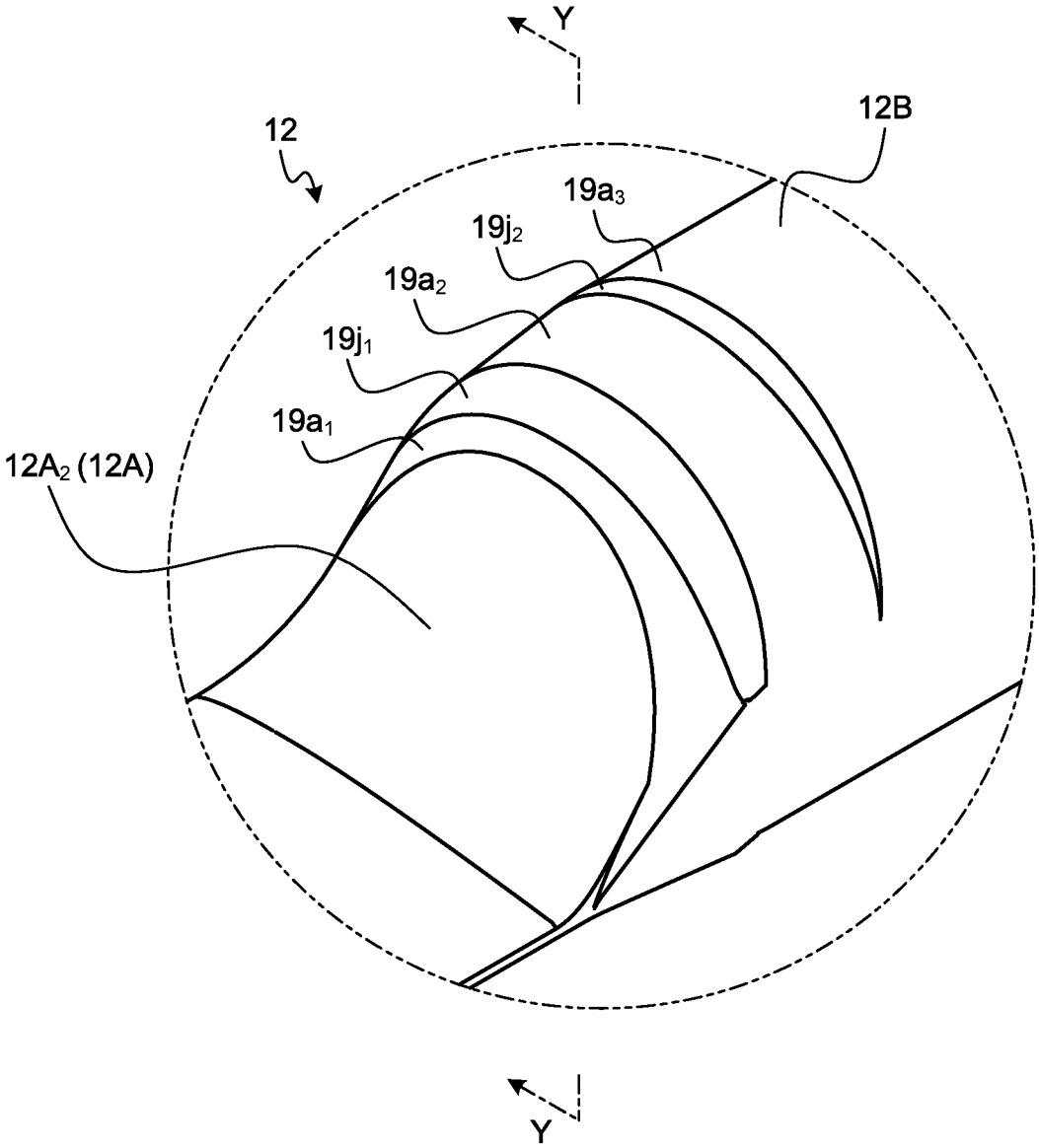
FIG. 9 is an enlarged view of a section A in FIG. 3.

The crimp terminal 1 includes at least a terminal fitting 10 (FIGS. 1 to 7). In the present embodiment, a description will be given by exemplifying the crimp terminal including only the terminal fitting 10, but the crimp terminal 1 may be provided with a water stop member 20 as illustrated in FIG. 8, for example. The water stop member 20 is a member for stopping water so as not to bring a liquid such as water into contact with the core wire 51 after completion of the crimping processing (hereinafter referred to as "after completion of crimping"). The water stop member 20 is pasted to the terminal fitting 10 and deforms along with the crimping processing of the crimp terminal 1 with respect to the electric wire 50 to cover the periphery of the bare core wire 51. In addition, due to such a deformation, the water stop member 20 is also interposed between a first barrel piece 15 and a second barrel piece 16 in an overlapping area to be described later.

The terminal fitting 10 is the main body part of the crimp terminal 1. The terminal fitting 10 is molded using a conductive material such as metal. Here, a conductive metal plate (for example, a copper plate) is used as a base material, and this base material is formed into a predetermined shape capable of being connected to the counterpart terminal and the electric wire 50 by press molding. As illustrated in FIGS. 1 to 8, the terminal fitting 10 includes a terminal connection portion 11 electrically connected to the counterpart terminal, an electric wire connection portion 12 electrically connected to the end of the electric wire 50. The terminal connection portion 11 and the electric wire connection portion 12 are coupled by a coupling portion 13 interposed therebetween.

The terminal fitting 10 may be a male terminal or a female terminal. The terminal connection portion 11 is formed in a male type when the terminal fitting 10 is the male terminal, and is formed in a female type when the terminal fitting 10 is the female terminal. The present embodiment will be described by exemplifying the female terminal.

Here, in this crimp terminal 1, an insertion and extraction direction (a connection direction and a separation direction) with respect to the counterpart terminal is defined as a longitudinal direction, and this longitudinal direction is defined as a first direction L. In addition, a direction along the plane of the base material before press molding among directions orthogonal to the first direction L is defined as a width direction, and this width direction is defined as a second direction W in the crimp terminal 1. The second direction W is also a parallel arrangement direction of the crimp terminal 1 to be described later. In addition, in the crimp terminal 1, a direction orthogonal to each of the first direction L and the second direction W is defined as a height direction, and this height direction is defined as a third direction H.

Figure 5:
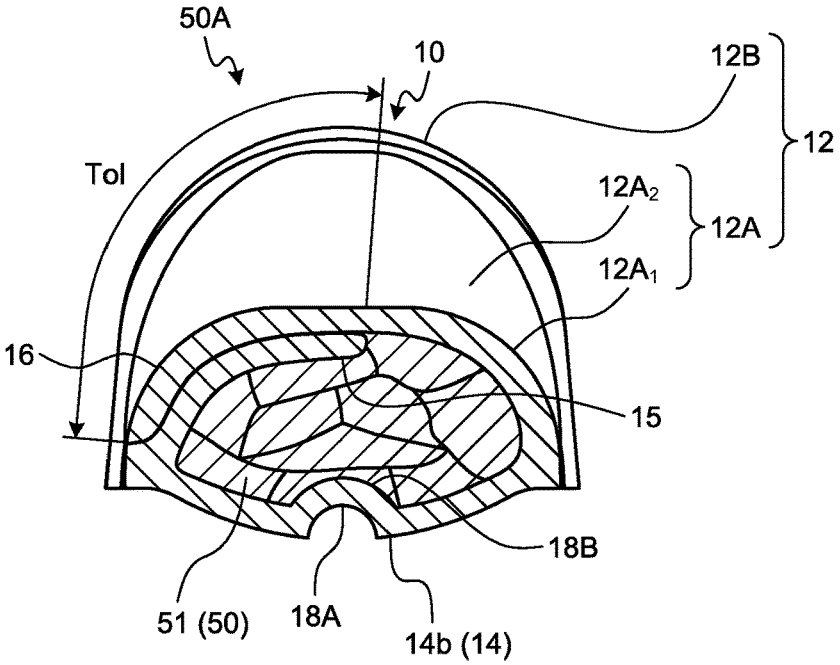
FIG. 5 is a cross-sectional view taken along a line X-X of FIG. 4.

First, the electric wire connection portion 12 is formed into a single plate shape (FIGS. 6 and 7), and is formed in a U-shape as a state immediately before connection with the electric wire 50 (FIG. 1). The electric wire connection portion 12 formed in the U-shape is crimped to the end of the electric wire 50 by being wound around the electric wire 50 in a state where the end of the electric wire 50 is placed on an inner wall surface side of the electric wire connection portion 12, thereby being brought into contact with the bare core wire 51. The electric wire connection portion 12 is electrically connected to the core wire 51 at the end of the electric wire 50 along with the crimping processing on the end of the electric wire 50 placed on the inner wall surface side as described above. As will be described later, the electric wire connection portion 12 has a bottom 14 and the pair of barrel pieces (the first barrel piece 15 and the second barrel piece 16), and the pair of barrel pieces is wound around the end of the electric wire 50 placed on the bottom 14 (FIG. 5). The pair of barrel pieces is wound around the end of the electric wires 50 to overlap each other.

The electric wire connection portion 12 has a core wire crimping portion 12A and a sheath crimping portion 12B (FIGS. 2 to 8). The electric wire connection portion 12 can be partitioned into an area of the core wire crimping portion 12A and an area of the sheath crimping portion 12B in the first direction L. The core wire crimping portion 12A is a part that is crimped to the bare core wire 51 in the end of the electric wire 50 to be crimped. A part that corresponds to the core wire crimping portion 12A in the bottom 14 and the pair of barrel pieces (the first barrel piece 15 and the second barrel piece 16) to be described later is crimped to the core wire 51. The core wire crimping portion 12A is connected to the coupling portion 13. The sheath crimping portion 12B is a part that is crimped to the sheath 52 in the end of the electric wire 50 to be crimped. A part that corresponds to the sheath crimping portion 12B in the bottom 14 and the pair of barrel pieces is crimped to the sheath 52.

Further, the electric wire connection portion 12 has the bottom 14 and the pair of barrel pieces (the area of the first barrel piece 15 and the second barrel piece 16) (FIGS. 1, 5, 7, and 8). The electric wire connection portion 12 can be partitioned into an area of the bottom 14, an area of the first barrel piece 15, and an area of the second barrel piece 16 in the second direction W. During the crimping processing, the electric wire connection portion 12 allows the end of the electric wire to be inserted into a U-shaped inner space surrounded by the bottom 14 and the pair of barrel pieces.

Figure 2:
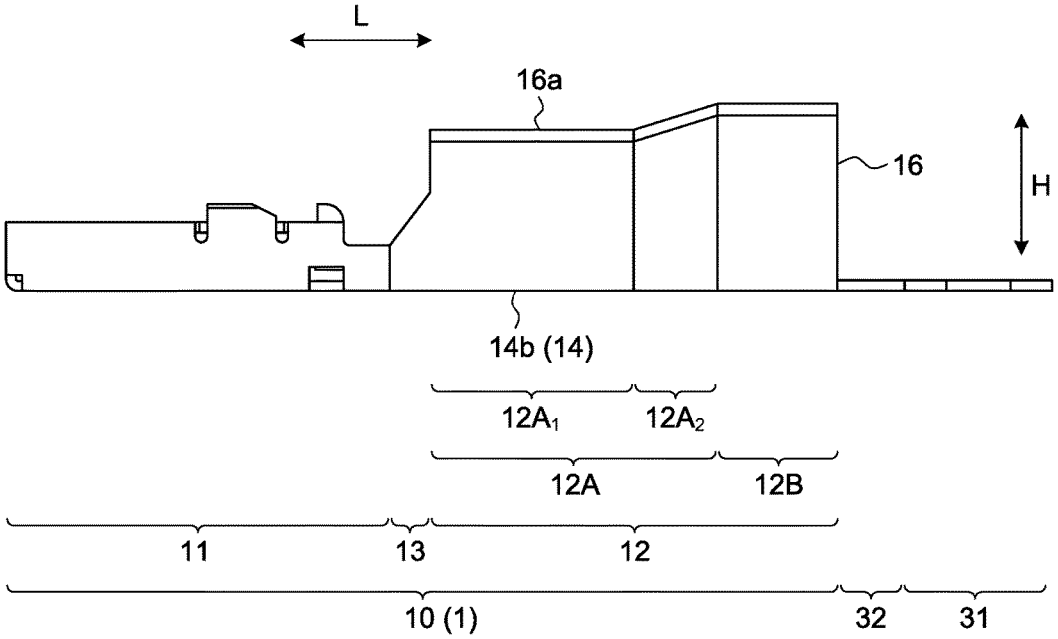
FIG. 2 is a side view illustrating a crimp terminal according to the embodiment and illustrates a state where an electric wire connection portion is formed in a U-shape.
Figure 10:
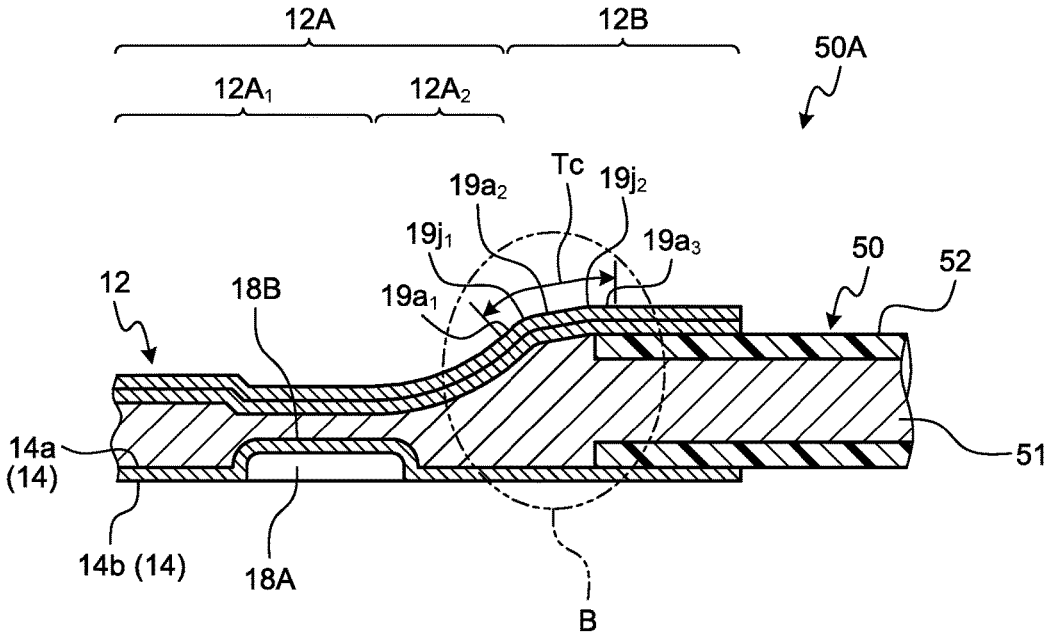
FIG. 10 is a cross-sectional view taken along a line Y-Y of FIG. 9.

The bottom 14 is a part serving as a bottom wall of the U-shaped electric wire connection portion 12. The bottom 14 has a placement surface 14*a* on the inner wall surface side where the end of the electric wire 50 is placed during the crimping processing (FIGS. 7, 8, and 10). In addition, the bottom 14 is placed on the support portions (the first support surface 112$A_1$ and the second support surface 112$B_1$) of the first mold 112, which will be described later, and is supported by the support portions during the crimping processing. The bottom 14 has a supported surface 14*b* that is supported by the support portion during the crimping processing on an outer wall surface side (FIGS. 2, 5, and 10).

Each of the first barrel piece 15 and the second barrel piece 16 is a piece extending from both ends in a crossing direction with respect to the axis of the end of the electric wire 50 at the bottom 14 (that is, in the second direction W). Each of the first barrel piece 15 and the second barrel piece 16 in this example is formed as a single piece continuous from the core wire crimping portion 12A to the sheath crimping portion 12B. Thus, the first barrel piece 15 and the second barrel piece 16 extend from both the ends of the bottom 14 so as to surround the end of the electric wire 50 placed on the bottom 14 in the U-shaped electric wire connection portion 12. Each of the first barrel piece 15 and the second barrel piece 16 is crimped to the core wire 51 and the sheath 52 of the end of the electric wire 50 at the core wire crimping portion 12A and the sheath crimping portion 12B. The respective first barrel piece 15 and the second barrel piece 16 are crimped to the end of the electric wire 50 while being pressed toward the support portions (the first support surface 112$A_1$ and the second support surface 112$B_1$) by the pressing portions (the core wire pressing portion 113$A_1$ and the sheath pressing portion 113$B_1$) of the second mold 113, which will be described later, during the crimping processing. The first barrel piece 15 and the second barrel piece 16 are wound around the end of the electric wire 50 by a pressing force from the pressing portion of the second mold 113 during the crimping processing.

The first barrel piece 15 and the second barrel piece 16 may be formed such that each distance thereof from the root of the bottom 14 side to end surfaces of distal ends 15*a* and 16*a* is the same length or may be formed such that one of the distances thereof is longer than the other. The first barrel piece 15 and the second barrel piece 16 are wound around the end of the electric wire 50 while overlapping each other.

In the electric wire connection portion 12, an area where the first barrel piece 15 and the second barrel piece 16 overlap each other (hereinafter referred to as the "overlapping area") Tol is formed after completion of crimping (FIG. 5). Specifically, the overlapping area Tol is an area where one barrel piece on the outer side after completion of crimping and the other barrel piece on the inner side after completion of crimping overlap each other, and is the area in which an inner wall surface of the outer barrel piece and an outer wall surface of the inner barrel piece oppose each other. In this example, the second barrel piece 16 is made longer than the first barrel piece 15. Thus, in the electric wire connection portion 12, the first barrel piece 15 becomes a barrel piece wound around the end of the electric wire 50 at the inner side, and the second barrel piece 16 becomes a barrel piece wound around the end of the electric wire 50 at the outer side. Therefore, during the crimping processing, the first barrel piece 15 is wound around an outer circumferential surface of the end of the electric wire 50, and the second barrel piece 16 is wound so as to cover the end of the electric wire 50 in this state and the first barrel piece 15 from an outer circumferential surface side. In the electric wire connection portion 12, the first barrel piece 15 and the second barrel piece 16 are caulked to the end of the electric wire 50 in this manner.

Herein, the electric wire connection portion 12 before the crimping processing is formed in the U-shape with the bottom 14 and the pair of barrel pieces (the first barrel piece 15 and the second barrel piece 16). Thus, the electric wire connection portion 12 before the crimping processing has the space at the inner side of this U-shape and has an opening between the end surfaces of the respective distal ends 15*a* and 16*a*. At the time of performing the crimping processing, the end of the electric wire 50 is inserted into the inner space from the U-shaped opening of the electric wire connection portion 12. In a state where the end of the electric wire 50 is inserted into the space, the electric wire connection portion 12 is crimped to the end of the electric wire 50 by winding the pair of barrel pieces around the end of the electric wire 50 while shortening a distance between the first mold 112 and the second mold 113. In the electric wire connection portion 12, the core wire crimping portion 12A and the sheath crimping portion 12B are formed along with the winding of the pair of barrel pieces. Therefore, the distance between the first barrel piece 15 and the second barrel piece 16 is widened from the bottom 14 side toward the opening (the distal ends 15*a* and 16*a*) such that the end of the electric wire 50 is easily inserted in the electric wire connection portion 12.

A core wire holding area (hereinafter referred to as a "serration area") 17 for holding the crimped core wire 51 is provided on an inner wall surface (a wall surface on the side covering the end of the electric wire 50) of the electric wire connection portion 12 (FIGS. 6 to 8). The serration area 17 is constituted by a plurality of serrations 17*a* formed as recesses or protrusions. The serration area 17 increases the contact area between the electric wire connection portion 12 and the core wire 51 with the respective serrations 17*a* to increase adhesion strength therebetween and improve an electrical connection state therebetween. The serration area 17 is arranged at least in a part of the inner wall surface of the electric wire connection portion 12 which is wound around the bare core wire 51. The serration area 17 may be constituted by the plurality of concave serrations 17*a*, may be constituted by the plurality of convex serrations 17*a*, or may be constituted by the plurality of concave serrations 17*a* and the plurality of convex serrations 17*a* in combination. The serration area 17 in this example is formed so as to entirely cover the core wire 51 with the plurality of concave serrations 17*a*.

The bottom 14 of the core wire crimping portion 12A has a recess 18A (FIGS. 5, 7, 8, and 10) obtained by recessing a part of the supported surface 14*b* toward the inner wall surface, and a protrusion 18B (FIGS. 5 to 8 and 10) protruding from the inner wall surface toward the core wire 51 at the end of the electric wire 50 by the recess of the recess 18A. The recess 18A and the protrusion 18B extend along a direction in which the electric wire 50 is drawn out from the crimp terminal 1.

As described above, the bottom 14 of the electric wire connection portion 12 is supported by the support portions (the first support surface 112$A_1$ and the second support surface 112$B_1$) of the first mold 112 to be described later. The recess 18A is used, for example, to achieve positioning of the electric wire connection portion 12 at the support portion and to hold a support posture of the electric wire connection portion 12 at the support portion. Accordingly, a convex pressing portion 112*a*, which will be described later, provided in the support portion of the first mold 112 is inserted in the recess 18A. As the distance between the first mold 112 and the second mold 113 is shortened during the crimping processing, a pressing force from the convex pressing portion 112*a* is applied on the wall surface of the recess 18A. The recess 18A is deformed into a shape in accordance with the shape of the convex pressing portion 112*a* by such a pressing force.

The protrusion 18B can sandwich the core wire 51 at the end of the electric wire 50 with the pair of barrel pieces (the first barrel piece 15 and the second barrel piece 16). The protrusion 18B protrudes from the inner wall surface when the recess 18A is formed. For example, the protrusion 18B is deformed into a shape corresponding to the shape of the convex pressing portion 112*a* in conjunction with the deformation of the recess 18A during the crimping processing. Accordingly, the protrusion 18B presses the core wire 51 at the end of the electric wire 50 with the pair of barrel pieces as the crimping processing progresses, and thus, can be used to enhance the crimping force after completion of crimping.

In the bottom 14 of the core wire crimping portion 12A, the serration 17*a* is formed at a place excluding the protrusion 18B.

Figure 11:
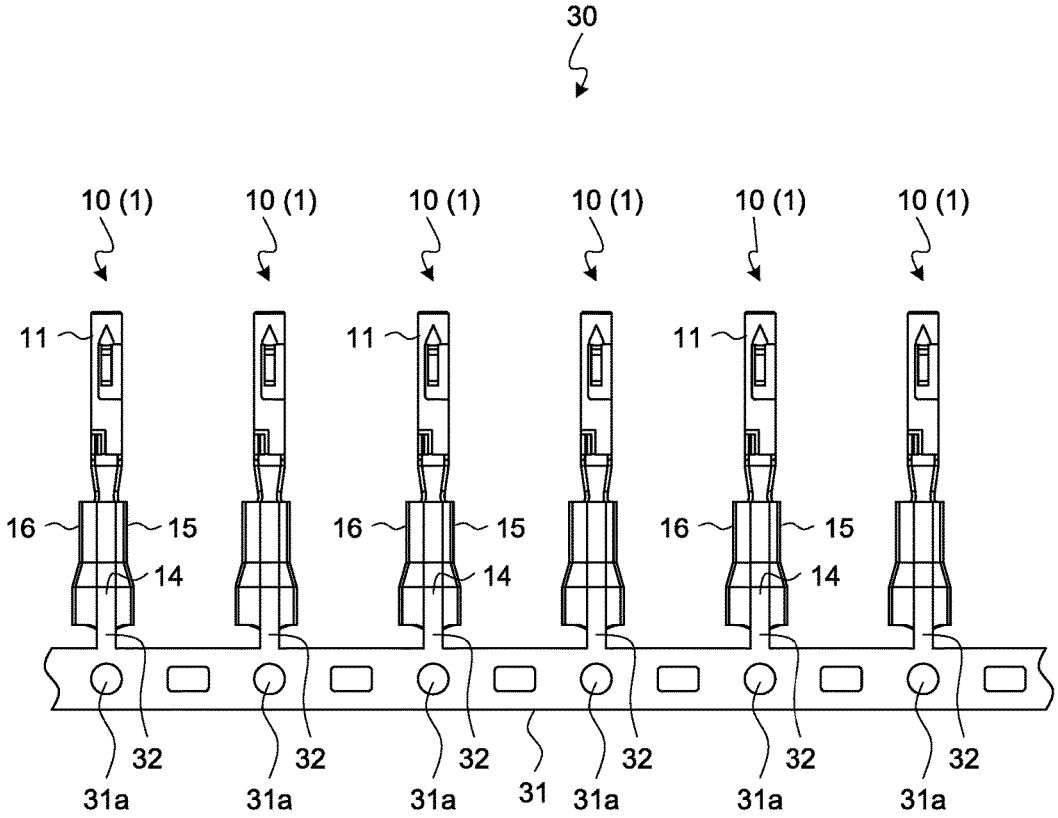
FIG. 11 is a view illustrating a terminal chain body.

In this crimp terminal 1, the terminal fitting 10 having the plate-shaped electric wire connection portion 12 is formed through the press molding step with respect to the base material (FIGS. 6 and 7). A plurality of the crimp terminals 1 are arranged side by side to form a chain body (hereinafter referred to as a "terminal chain body") 30 (FIG. 11). The terminal chain body 30 refers to an aggregate of the plurality of crimp terminals 1 arranged in parallel at regular intervals in the state of facing the same direction and connected in a chain shape. In the terminal chain body 30, one ends of all the crimp terminals 1 are connected by a coupling piece 31. The coupling piece 31 is formed into a rectangular plate shape, for example, and arranged with a predetermined distance with respect to the electric wire connection portions 12 of all the crimp terminals 1. The bottom 14 of the electric wire connection portion 12 and the coupling piece 31 are connected to each of the crimp terminals 1 via, for example, a rectangular plate-shaped connecting portion 32. Through holes (hereinafter referred to as "terminal feeding holes") 31*a* for feeding the terminal chain body 30 to a crimping position of a terminal crimping apparatus 100 are formed in the coupling piece 31 at regular intervals along a feeding direction of the terminal chain body 30. The terminal chain body 30 formed in this manner is arranged in the terminal crimping apparatus 100 (FIG. 12) in the state of being wound in a reel shape (not illustrated). In the terminal crimping apparatus 100, the electric wire connection portion 12 folded in a U-shape is crimped to the end of the electric wire 50. In addition, a terminal cutting step of separating the crimp terminal 1 from the terminal chain body 30 is performed simultaneously with a crimping step in the terminal crimping apparatus 100.

The terminal crimping apparatus 100 will be described.

Figure 12:
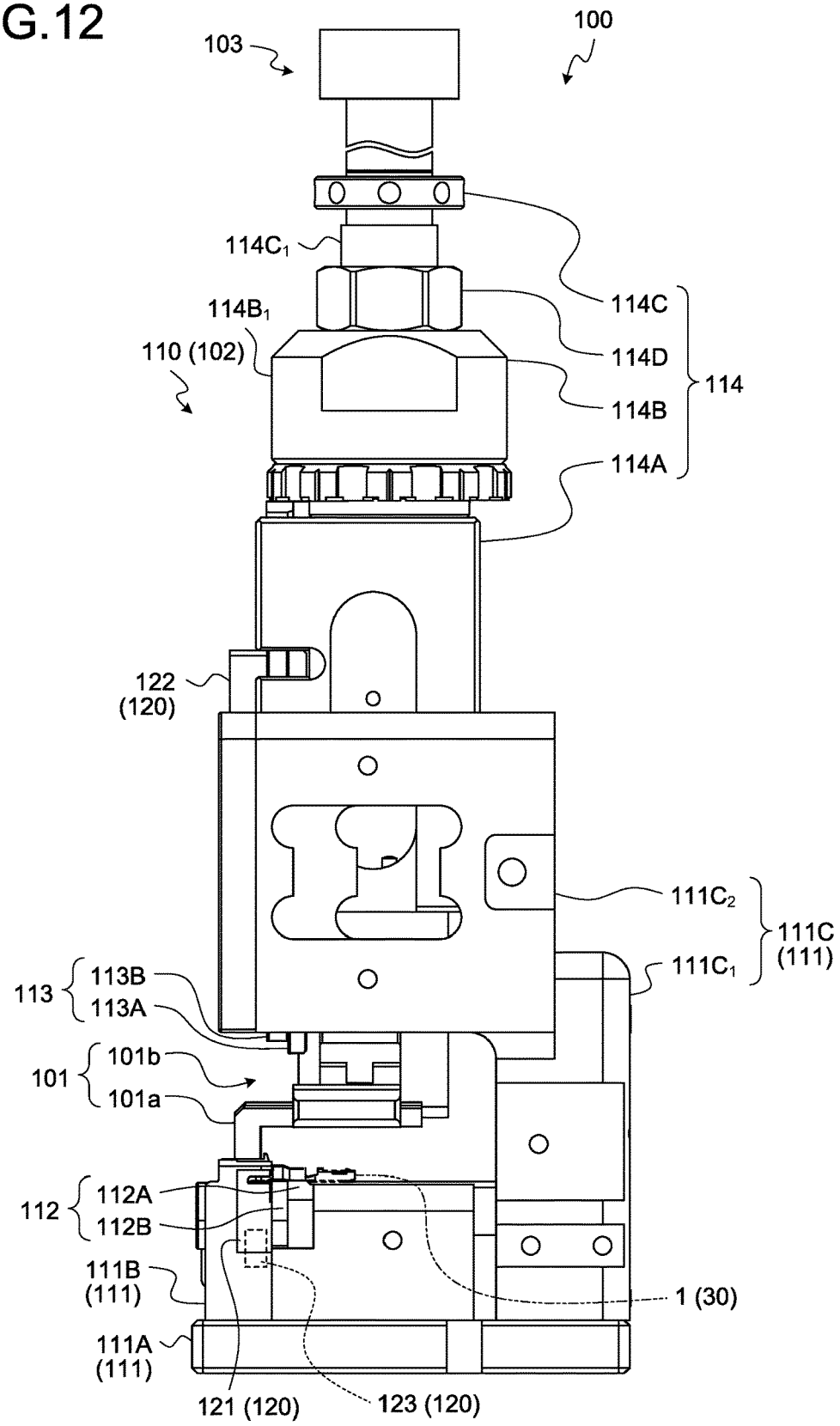
FIG. 12 is a view for describing a terminal crimping apparatus of the embodiment.

As illustrated in FIG. 12, the terminal crimping apparatus 100 includes a terminal supplying device 101 that supplies the crimp terminal 1 to a predetermined crimping position, a crimping apparatus 102 that crimps the crimp terminal 1 to the end of the electric wire 50 at the crimping position, and a driving device 103 configured to operate the terminal supplying device 101 and the crimping apparatus 102. The terminal supplying device 101 and the crimping apparatus 102 are devices called applicators in this technical field.

The terminal supplying device 101 draws out a leading crimp terminal 1 on an outer circumference side of the terminal chain body 30 wound in the reel shape to be successively supplied to the crimping position. After finishing crimping of the leading crimp terminal 1 to the end of the electric wire 50 and cutting thereof from the terminal chain body 30, the terminal supplying device 101 supplies a new leading crimp terminal 1 to the crimping position. The operation of the terminal supplying device 101 is repeated sequentially each time the crimping processing and the cutting processing are performed.

This terminal supplying device 101 has a well-known configuration in this technical field, and includes a terminal feeding member 101*a* which is inserted into the terminal feeding hole 31*a* of the coupling piece 31, and a power transmission mechanism 101*b* that drives the terminal feeding member 101*a* by power of the driving device 103. The power transmission mechanism 101*b* is configured as a link mechanism that operates in conjunction with the crimping operation of the crimping apparatus 102 (vertical movement of a ram 114A or the like to be described later). The terminal supplying device 101 in this example supplies the crimp terminal 1 to the crimping position by driving the terminal feeding member 101*a* in the vertical direction and the lateral direction in conjunction with the crimping operation of the crimping apparatus 102.

The crimping apparatus 102 performs crimping of the supplied crimp terminal 1 to the end of the electric wire 50 and separating of the crimp terminal 1 from the terminal chain body 30. Thus, the crimping apparatus 102 includes a crimping machine 110 and a terminal cutting machine 120.

The crimping machine 110 is a device that crimps the crimp terminal 1 to the end of the electric wire 50 by caulking the crimp terminal 1 supplied to the crimping position to the end of the electric wire 50. The crimping machine 110 in this example crimps the crimp terminal 1 to the electric wire 50 by caulking each of the first barrel piece 15 and the second barrel piece 16 of the crimp terminal 1 to the core wire 51 at the distal end and the sheath 52 of the electric wire 50. The crimping machine 110 includes a frame 111, the first mold 112 and the second mold 113 paired with each other, and a power transmission mechanism 114.

The frame 111 includes a base 111A, an anvil support 111B, and a support (hereinafter, referred to as a "transmission unit support") 111C for the power transmission mechanism 114. The base 111A is fixed onto a pedestal (not illustrated) on which the terminal crimping apparatus 100 is placed, for example. The anvil support 111B and the transmission unit support 111C are fixed onto the base 111A. The transmission unit support 111C is arranged at the rear side (the right side in the sheet plane in FIG. 12) and the upper side (the upper side in the sheet plane in FIG. 12) of the anvil support 111B. Specifically, the transmission unit support 111C includes a standing portion 111$C_1$ standing upward from the base 111A at the rear side of the anvil support 111B, and a ram support portion 111$C_2$ held at the upper part of the standing portion 111$C_1$. The ram support portion 111$C_2$ is a support portion that supports the ram 114A to be described later, and is arranged above the anvil support 111B with a predetermined distance therebetween.

Figure 13:
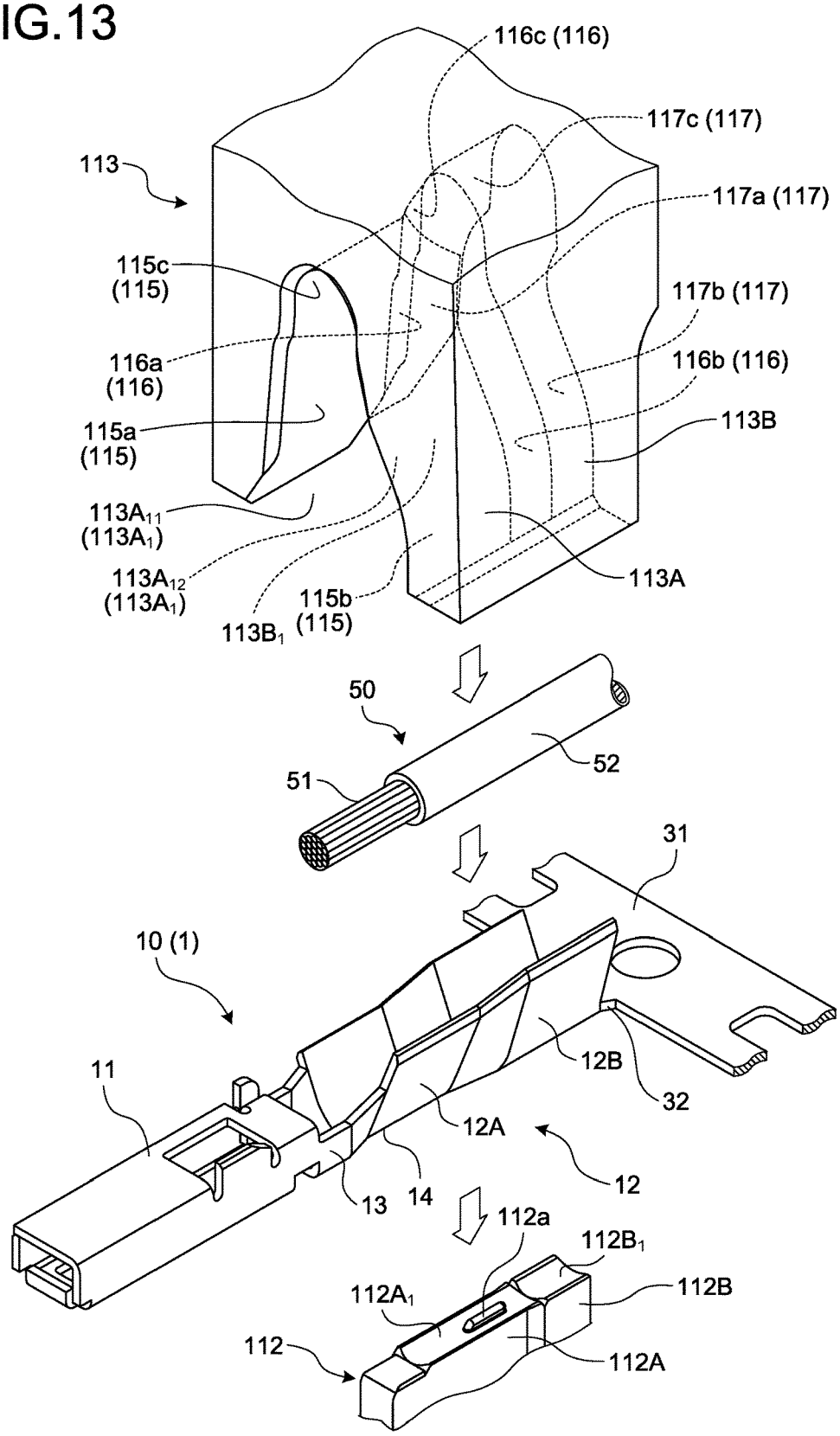
FIG. 13 is a perspective view for describing first and second molds.

The first mold 112 and the second mold 113 are arranged with a distance therebetween in the vertical direction, and are crimping molds that sandwich the crimp terminal 1 and the end of the electric wire 50 placed therebetween to crimp the crimp terminal 1 to the end of the electric wire 50 (FIG. 13). The first mold 112 is formed with two lower dies, and has a first anvil 112A and a second anvil 112B as the lower dies. The second mold 113 is formed with two upper dies, and has a first crimper 113A and a second crimper 113B as the upper dies. The first anvil 112A and the first crimper 113A are arranged to oppose each other in the vertical direction, and crimp the U-shaped core wire crimping portion 12A to the core wire 51 at the distal end by narrowing a distance therebetween. In addition, the second anvil 112B and the second crimper 113B are arranged to oppose each other in the vertical direction, and crimp the U-shaped sheath crimping portion 12B to the sheath 52 by narrowing a distance therebetween.

The driving device 103 transmits its power to the power transmission mechanism 114 to adjust the distance between the first anvil 112A and the first crimper 113A and the distance between the second anvil 112B and the second crimper 113B. At the time of performing the crimping processing, the space between the first anvil 112A and the first crimper 113A and the space between the second anvil 112B and the second crimper 113B are narrowed. On the other hand, when the crimping processing is finished, the space between the first anvil 112A and the first crimper 113A and the space between the second anvil 112B and the second crimper 113B are widened. In this example, the first crimper 113A and the second crimper 113B are vertically moved with respect to the first anvil 112A and the second anvil 112B at the same time by vertically moving the second mold 113 with respect to the first mold 112. However, the first anvil 112A, the second anvil 112B, the first crimper 113A, and the second crimper 113B may be molded bodies which are individually molded. In this case, the driving device 103 and the power transmission mechanism 114 may be configured to vertically move the first crimper 113A and the second crimper 113B separately. In this example, the crimping of the sheath crimping portion 12B by the second anvil 112B and the second crimper 113B starts after the crimping of the core wire crimping portion 12A is started by the first anvil 112A and the first crimper 113A.

The power transmission mechanism 114 of the present embodiment transmits the power output from the driving device 103 to the first crimper 113A and the second crimper 113B. As illustrated in FIG. 12, the power transmission mechanism 114 includes the ram 114A, a ram bolt 114B, and a shank 114C.

The ram 114A is a movable member that is supported to be vertically movable with respect to the ram support portion 111$C_2$. The second mold 113 is fixed to the ram 114A. Thus, the first crimper 113A and the second crimper 113B can vertically move with respect to the ram support portion 111$C_2$ integrally with the ram 114A. For example, the ram 114A is formed in a rectangular shape. A female screw (not illustrated) is formed in the ram 114A. The female screw is formed at an inner circumferential surface of a hole in the vertical direction formed toward an upper end surface from the inner side of the ram 114A.

The ram bolt 114B has a male screw (not illustrated) to be screwed into the female screw of the ram 114A. Thus, the ram bolt 114B can vertically move with respect to the ram support portion 111$C_2$ integrally with the ram 114A. In addition, the ram bolt 114B has a bolt head 114$B_1$ arranged above the male screw. The female screw (not illustrated) is formed on the bolt head 114$B_1$. The female screw is formed on the inner circumferential surface of the hole in the vertical direction formed from the inner side of the bolt head 114$B_1$ to the upper end surface.

The shank 114C is a cylindrical hollow member, and has a male screw 114$C_1$ and a connection portion (not illustrated) at the respective ends thereof. The male screw 114$C_1$ of the shank 114C is formed on the lower side of the hollow member and is screwed into the female screw of the bolt head 114$B_1$ of the ram bolt 114B. Thus, the shank 114C can move vertically with respect to the ram support portion 111$C_2$ integrally with the ram 114A and the ram bolt 114B. The connection portion is connected to the driving device 103.

The driving device 103 has a driving source (not illustrated) and a power conversion mechanism (not illustrated) that converts a driving force of the driving source into power in the vertical direction. The connection portion of the shank 114C is connected to an output shaft of the power conversion mechanism. Thus, the first crimper 113A and the second crimper 113B vertically move with respect to the ram support portion 111$C_2$ integrally with the ram 114A, the ram bolt 114B, and the shank 114C by the output of the driving device 103 (the output of the power conversion mechanism). As the driving source, an electric actuator such as an electric motor, a hydraulic actuator such as a hydraulic cylinder, a pneumatic actuator such as an air cylinder, or the like can be applied.

Here, a relative position of the second mold 113 with respect to the first mold 112 in the vertical direction can be changed by adjusting the amount of screwing of the female screw of the bolt head 114$B_1$ and the male screw 114$C_1$ of the shank 114C. That is, a relative position of the first crimper 113A with respect to the first anvil 112A in the vertical direction and a relative position of the second crimper 113B with respect to the second anvil 112B in the vertical direction can be changed by adjusting the screwing amount of the crimping machine 110. A nut 114D is screwed with the male screw 114$C_1$ of the shank 114C above the ram bolt 114B and has a function so-called a lock nut together with the female screw of the bolt head 114$B_1$. Thus, it is possible to fix the first crimper 113A and the second crimper 113B to the relative positions by fastening the nut 114D to the ram bolt 114B side after completion of the adjustment of the relative positions.

The first mold 112 has the support portion that supports the supported surface 14*b* of the bottom 14 of the crimp terminal 1 at the crimping position. The support portion is formed as the support surface capable of supporting the supported surface 14*b* by the surface. The first mold 112 includes the first support surface 112$A_1$ and the second support surface 112$B_1$ as the support portions thereof (FIG. 13). As the supported surface 14*b* of the bottom 14 of the core wire crimping portion 12A is placed, the first support surface 112$A_1$ supports the supported surface 14*b*. As the supported surface 14*b* of the bottom 14 of the sheath crimping portion 12B is placed, the second support surface 112$B_1$ supports the supported surface 14*b*.

Recessed surfaces recessed downward are formed at distal ends on each upper side of the first anvil 112A and the second anvil 112B, respectively. The recessed surface of the first anvil 112A is used as the first support surface 112$A_1$. In addition, the recessed surface of the second anvil 112B is used as the second support surface 112$B_1$. Each of the first support surface 112$A_1$ and the second support surface 112$B_1$ is formed in an arc shape in accordance with a shape of the bottom 14 of each of the U-shaped core wire crimping portion 12A and the U-shaped sheath crimping portion 12B. The first mold 112 is supported by the anvil support 111B in a state where the first support surface 112$A_1$ and the second support surface 112$B_1$ are exposed upward.

The crimp terminal 1 that has been supplied with the bottom 14 on the lower side thereof moves to a terminal support step of supporting the supported surface 14*b* of the bottom 14 with the first mold 112. In the terminal support step, when the crimp terminal 1 is supplied to the crimping position, the supported surface 14*b* of the bottom 14 of the core wire crimping portion 12A is supported by the first support surface 112$A_1$ at the upper end of the first anvil 112A, and the supported surface 14*b* of the bottom 14 of the sheath crimping portion 12B is supported by the second support surface 112$B_1$ at the upper end of the second anvil 112B.

The first mold 112 includes the convex pressing portion 112*a*, which protrudes from the first support surface 112$A_1$ to the second mold 113, on the first support surface 112$A_1$ (FIG. 13). The convex pressing portion 112*a* is a part that is inserted into the recess 18A, and is extended along the drawing direction of the electric wire 50 from the crimp terminal 1. When the supported surface 14*b* of the bottom 14 of the core wire crimping portion 12A is supported by the first support surface 112$A_1$ of the first anvil 112A, the convex pressing portion 112*a* is inserted into the recess 18A formed at the bottom 14 of the core wire crimping portion 12A. That is, when the supported surface 14*b* is supported by the first support surface 112$A_1$ in the terminal support step, the convex pressing portion 112*a* is inserted into the recess 18A. In the state of being inserted into the recess 18A, the convex pressing portion 112*a* presses and deforms the wall surface of the recess 18A while shortening the distance with respect to the second mold 113, thereby forming the protrusion 18B on the bottom 14 of the core wire crimping portion 12A.

In the terminal crimping apparatus 100, the processing proceeds to a step of crimping the crimp terminal 1 to the electric wire 50 after such a terminal support step is performed. In the crimping step, the bottom 14 and the pair of barrel pieces are sandwiched between the first mold 112 and the second mold 113 while shortening the distance between the first mold 112 and the second mold 113 in a state where the end of the electric wire 50 is inserted into the space surrounded by the bottom 14 and the pair of barrel pieces (the first barrel piece 15 and the second barrel piece 16). In the crimping step, the pair of barrel pieces is wound around the end of the electric wire 50 to overlap each other while shortening the distance between the first mold 112 and the second mold 113, thereby forming the core wire crimping portion 12A crimped to the core wire 51 and the sheath crimping portion 12B crimped to the sheath 52.

The second mold 113 shortens the distance with respect to the first mold 112 in the state where the end of the electric wire 50 is inserted into the space surrounded by the bottom 14 and the pair of barrel pieces (the first barrel piece 15 and the second barrel piece 16). The second mold 113 sandwiches the bottom 14 and the pair of barrel pieces together with the first mold 112 while shortening the distance with respect to the first mold 112 and winds the pair of barrel pieces around the end of the electric wire 50 to overlap each other. The second mold 113 forms the core wire crimping portion 12A crimped to the core wire 51 and the sheath crimping portion 12B crimped to the sheath 52 by winding the pair of barrel pieces around the end of the electric wire 50.

The core wire pressing portion 113$A_1$, which crimps the pair of barrel pieces (the first barrel piece 15 and the second barrel piece 16) to the core wire 51 bare at the end of the electric wire 50, is formed in the first crimper 113A (FIG. 13). In addition, the sheath pressing portion 113$B_1$ which crimps the pair of barrel pieces to the sheath 52 at the end of the electric wire 50, is formed in the first crimper 113A (FIG. 13). Each of the core wire pressing portion 113$A_1$ and the sheath pressing portion 113$B_1$ has a concave shape recessed upward.

The core wire pressing portion 113$A_1$ is arranged to oppose the first support surface 112$A_1$ of the first anvil 112A in the vertical direction. The core wire pressing portion 113$A_1$ crimps the core wire crimping portion 12A supported on the first support surface 112$A_1$ to the core wire 51. The sheath pressing portion 113$B_1$ is arranged to oppose the second support surface 112$B_1$ of the second anvil 112B in the vertical direction. The sheath pressing portion 113$B_1$ crimps the sheath crimping portion 12B supported on the second support surface 112$B_1$ to the sheath 52. When the crimping processing is performed, the core wire pressing portion 113$A_1$ and the sheath pressing portion 113$B_1$ contact the first barrel piece 15 and the second barrel piece 16, respectively, and caulk the first barrel piece 15 and the second barrel piece 16 to the end of the electric wire 50 while winding the first barrel piece 15 and the second barrel piece 16 to overlap each other.

The core wire pressing portion 113$A_1$ and the sheath pressing portion 113$B_1$ are arranged such that the distance between the core wire pressing portion 113$A_1$ and the first support surface 112$A_1$ in a relative movement direction between the first mold 112 and the second mold 113 is narrower than the distance between the sheath pressing portion 113$B_1$ and the second support surface 112$B_1$ in the relative movement direction. As a result, the electric wire connection portion 12 is crimped to the end of the electric wire 50 in a state where a distance between the bottom 14 and the pair of barrel pieces in a direction of sandwiching the sheath 52 in the sheath crimping portion 12B is set to be wider than a distance between the bottom 14 and the pair of barrel pieces (the first barrel piece 15 and the second barrel piece 16) in a direction of sandwiching the core wire 51 in the core wire crimping portion 12A. Accordingly, the core wire pressing portion 113$A_1$ has a first core wire pressing portion 113$A_{11}$ and a second core wire pressing portion 113$A_{12}$ so as to smoothly connect the core wire crimping portion 12A and the sheath crimping portion 12B (FIG. 13).

The first core wire pressing portion 113$A_{11}$ is formed to be arranged to oppose the first support surface 112$A_1$ of the first anvil 112A in the vertical direction and to crimp the pair of barrel pieces (the first barrel piece 15 and the second barrel piece 16) to the distal end side of the core wire 51. Accordingly, the first core wire pressing portion 113$A_{11}$ is arranged to oppose the first support surface 112$A_1$ on the side opposite to the second support surface 112$B_1$. On the other hand, the second core wire pressing portion 113$A_{12}$ is formed to be arranged to oppose the first support surface 112$A_1$ of the first anvil 112A in the vertical direction and to crimp the pair of barrel pieces to the core wire 51 existing between the first core wire pressing portion 113$A_{11}$ and the sheath pressing portion 113$B_1$. Accordingly, the second core wire pressing portion 113$A_{12}$ is arranged to oppose the first support surface 112$A_1$ on the second support surface 112$B_1$ side, that is, to oppose the second support surface 112$B_1$ between the first core wire pressing portion 113$A_{11}$ and the sheath pressing portion 113$B_1$. The second core wire pressing portion 113$A_{12}$ crimps the pair of barrel pieces to the core wire 51 while widening the distance between the bottom 14 and the pair of barrel pieces in the sandwiching direction of the core wire 51 as being directed from the first core wire pressing portion 113$A_{11}$ side to the sheath pressing portion 113$B_1$ side between the first core wire pressing portion 113$A_{11}$ and the sheath pressing portion 113$B_1$.

Figure 3:
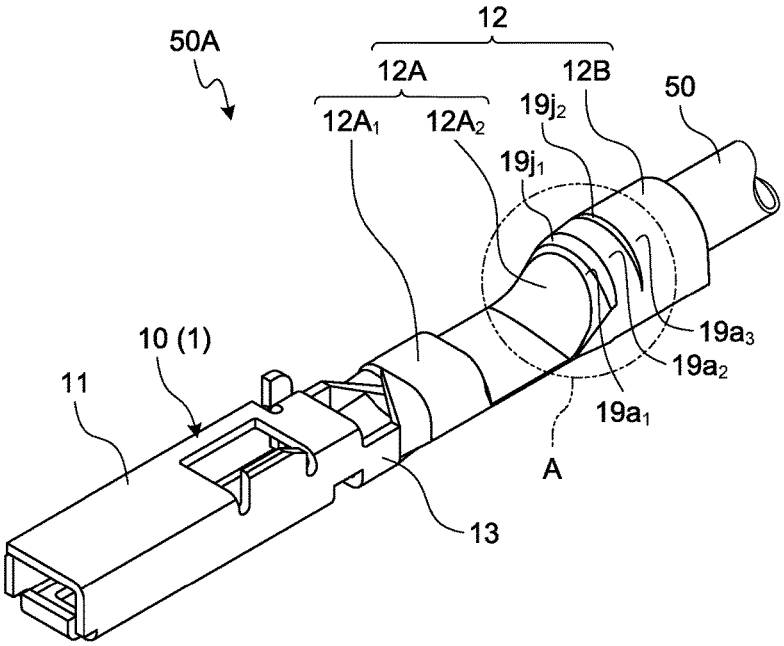
FIG. 3 is a perspective view illustrating a terminal-equipped electric wire after completion of crimping according to an embodiment.
Figure 4:
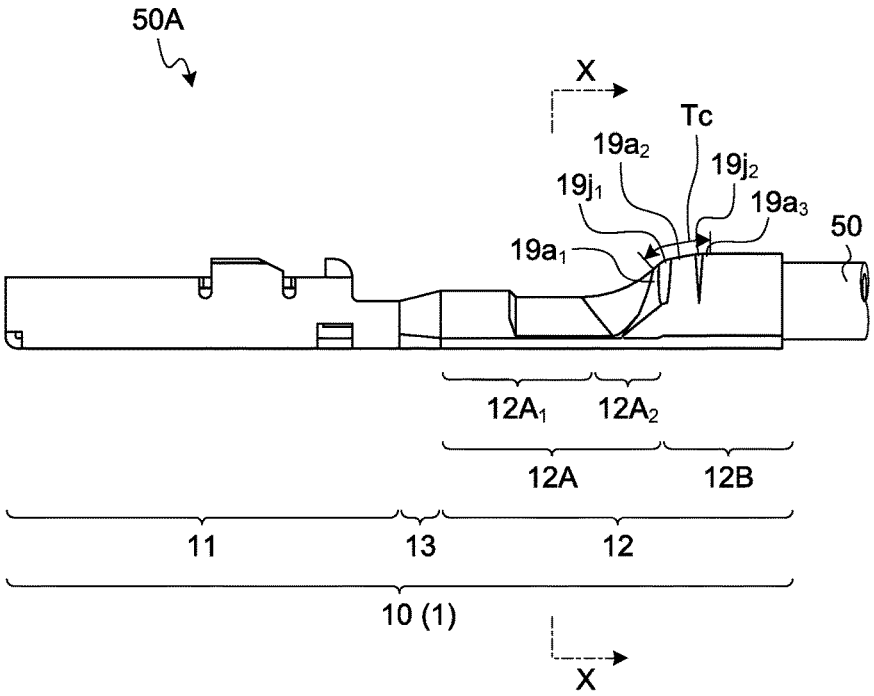
FIG. 4 is a side view illustrating the terminal-equipped electric wire after completion of crimping according to the embodiment.

The core wire pressing portion 113$A_1$ causes the core wire crimping portion 12A to have a first core wire crimping portion 12$A_1$ crimped by the first core wire pressing portion 113$A_{11}$ and a second core wire crimping portion 12$A_2$ crimped by the second core wire pressing portion 113$A_{12}$ (FIGS. 3, 4, and 10). In the first core wire crimping portion 12$A_1$, the pair of barrel pieces is crimped to the distal end side of the core wire 51. In the second core wire crimping portion 12$A_2$, the pair of barrel pieces is crimped to the core wire 51 between the distal end of the core wire 51 and the sheath 52. The second core wire crimping portion 12$A_2$ widens the distance with respect to the bottom 14 in the sandwiching direction of the core wire 51 as being directed from the first core wire crimping portion 12$A_1$ side to the sheath crimping portion 12B side between the first core wire crimping portion 12$A_1$ and the sheath crimping portion 12B such that the pair of barrel pieces is wound around the core wire 51. Accordingly, the core wire crimping portion 12A and the sheath crimping portion 12B are smoothly connected in the electric wire connection portion 12 after completion of crimping.

The first core wire pressing portion 113$A_{11}$, the second core wire pressing portion 113$A_{12}$, and the sheath pressing portion 113$B_1$ have pressing surfaces 115, 116, and 117, respectively, that contact the first barrel piece 15 and the second barrel piece 16 and caulk the first barrel piece 15 and the second barrel piece 16 to the end of the electric wire 50 while winding the first barrel piece 15 and the second barrel piece 16 when the crimping processing is performed (FIG. 13). The respective pressing surfaces 115, 116, and 117 are formed so as to perform such a caulking operation. For example, the pressing surface 115 has first and second wall surfaces 115*a* and 115*b* opposing each other, and an arc-shaped third wall surface 115*c* connecting upper ends of the first and second wall surfaces 115*a* and 115*b*. Similarly, the pressing surface 116 has first and second wall surfaces 116*a* and 116*b* opposing each other and an arc-shaped third wall surface 116*c* connecting upper ends of the first and second wall surfaces 116*a* and 116*b*. In addition, the pressing surface 117 has first and second wall surfaces 117*a* and 117*b* opposing each other and an arc-shaped third wall surface 117*c* connecting upper ends of the first and second wall surfaces 117*a* and 117*b*. Crimping shapes of the first core wire crimping portion 12$A_1$, the second core wire crimping portion 12$A_2$, and the sheath crimping portion 12B on the pair of barrel pieces side are formed by the respective third wall surfaces 115*c*, 116*c*, and 117*c* of the pressing surfaces 115, 116, and 117.

Figure 14:
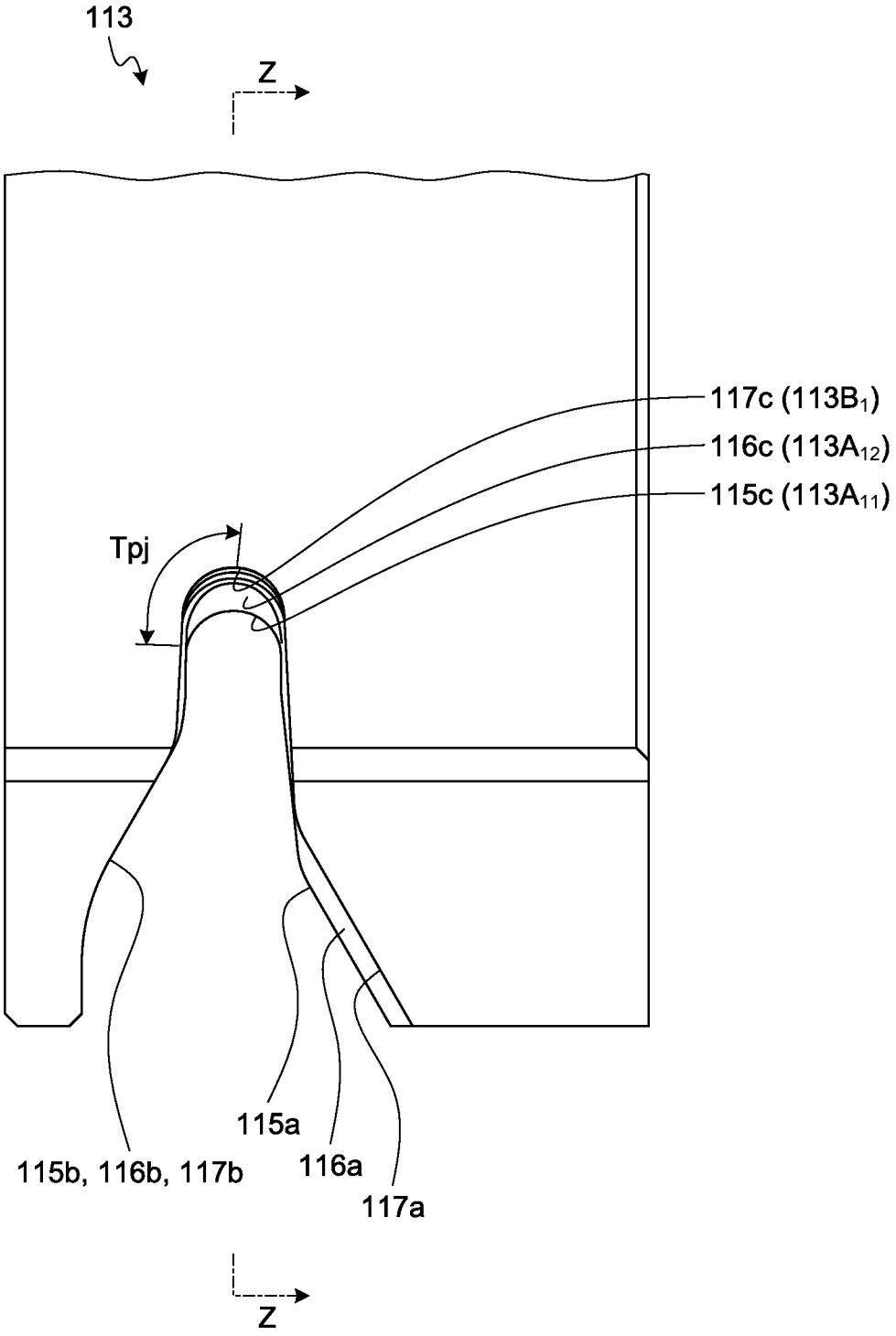
FIG. 14 is a rear view illustrating the second mold.

In the crimping step, the first core wire crimping portion 12$A_1$ is formed as the pair of barrel pieces (the first barrel piece 15 and the second barrel piece 16) is crimped to the distal end side of the core wire 51 by the first core wire pressing portion 113$A_{11}$. Further, at the same timing as the step of forming the first core wire crimping portion 12$A_1$ in the crimping step, the second core wire crimping portion 12$A_2$ is formed as the second core wire pressing portion 113$A_{12}$ crimps the pair of barrel pieces to the core wire 51 while widening the distance between the bottom 14 and the pair of barrel pieces in the sandwiching direction of the core wire 51 as being directed from the first core wire pressing portion 113$A_{11}$ side to the sheath pressing portion 113$B_1$ side. In addition, at the same timing as the step of forming the core wire crimping portion 12A in the crimping step, the sheath crimping portion 12B is further formed as the sheath pressing portion 113$B_1$ crimps the pair of barrel pieces to the sheath 52. The core wire pressing portion 113$A_1$ (the first core wire pressing portion 113$A_{11}$ and the second core wire pressing portion 113$A_{12}$) and the sheath pressing portion 113$B_1$ have pressing areas (hereinafter referred to as "joining pressing areas") Tpj for forming the above-described overlapping area Tol (FIG. 14). Accordingly, in this crimping step, the overlapping area Tol is formed in the first core wire crimping portion 12$A_1$, the second core wire crimping portion 12$A_2$, and the sheath crimping portion 12B at the same time as the first core wire crimping portion 12$A_1$, the second core wire crimping portion 12$A_2$, and the sheath crimping portion 12B are formed.

Since the convex pressing portion 112*a* is in the state of being inserted in the recess 18A of the core wire crimping portion 12A in the previous terminal support step, the wall surface of the recess 18A is pressed by the convex pressing portion 112*a* while crimping the pair of barrel pieces to the end of the electric wire 50 in this crimping step. Accordingly, the protrusion 18B is formed in the bottom 14 of the core wire crimping portion 12A by deforming the wall surface of the recess 18A with the convex pressing portion 112*a* in this crimping step.

Figure 15:
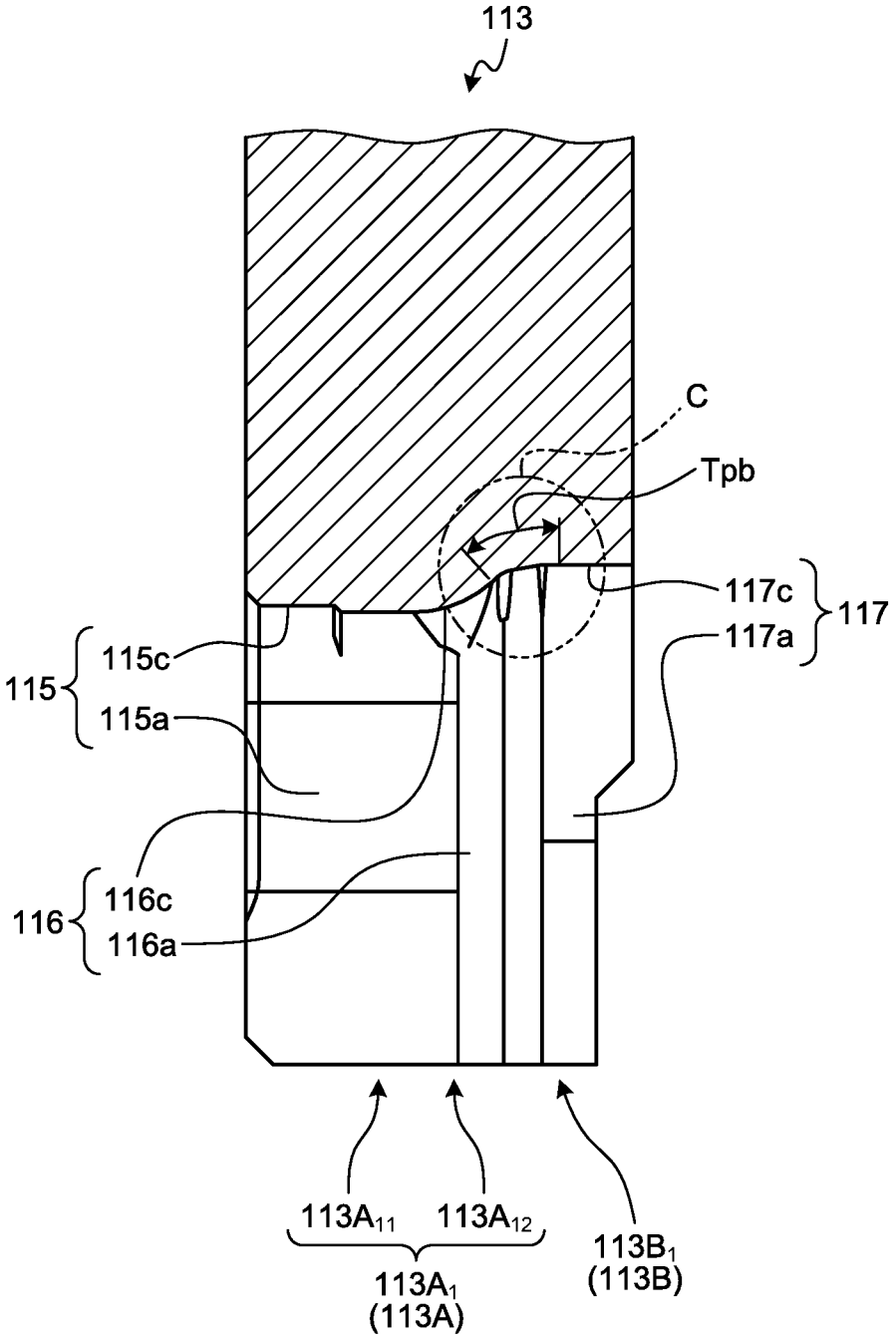
FIG. 15 is a cross-sectional view taken along a line Z-Z of FIG. 14.
Figure 16:
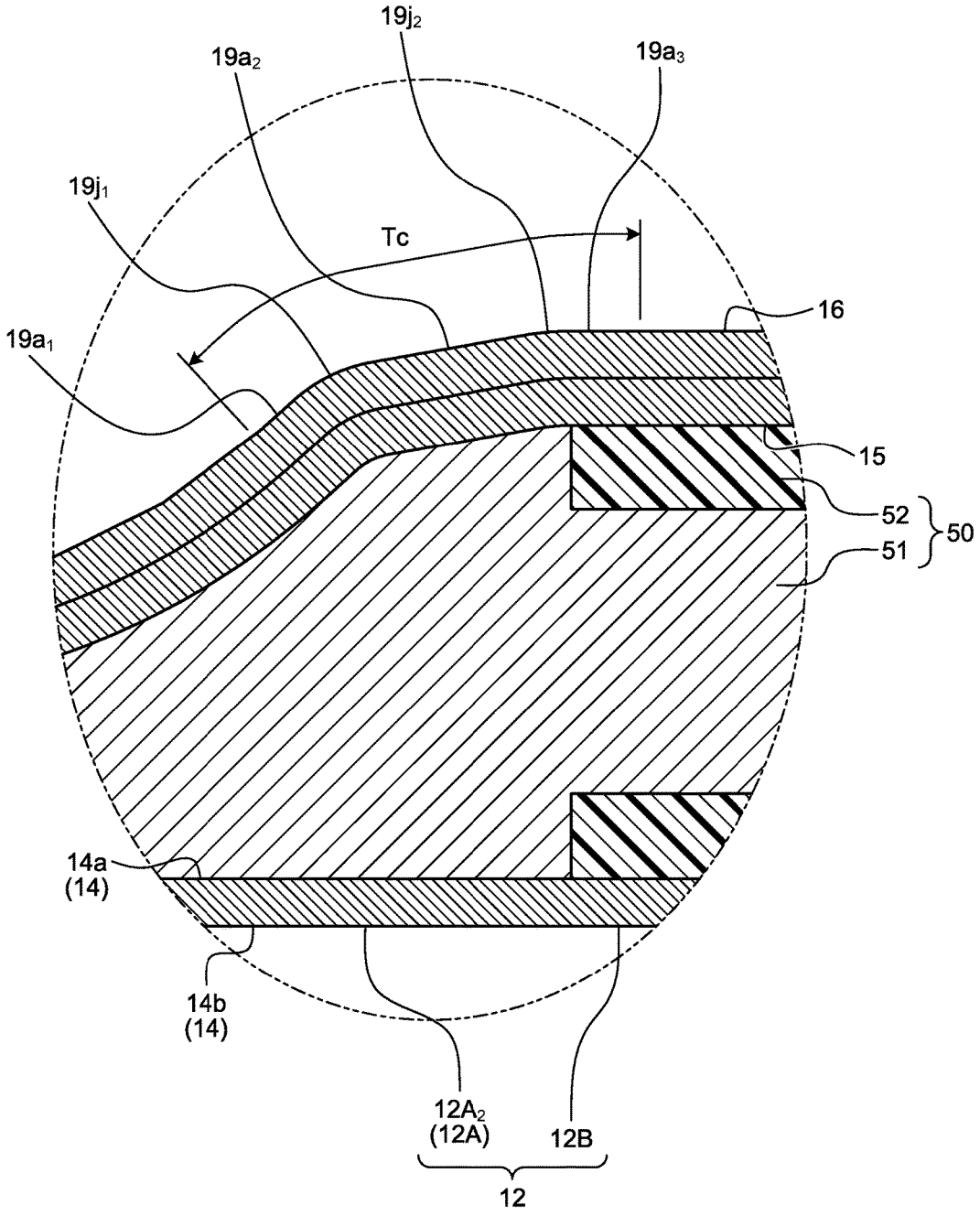
FIG. 16 is an enlarged view of a section B in FIG. 10.

Meanwhile, in the first anvil 112A, there is a pressing area (hereinafter referred to as a "boundary pressing area") Tpb arranged at a boundary part between the second core wire pressing portion 113$A_{12}$ and the sheath pressing portion 113$B_1$ (FIG. 15). The boundary pressing area Tpb forms a crimping area (hereinafter referred to as a "boundary crimping area") Tc arranged at the boundary part between the second core wire crimping portion 12$A_2$ and the sheath crimping portion 12B in the electric wire connection portion 12 (FIGS. 4, 10, and 16). The boundary pressing area Tpb is arranged to straddle the second core wire pressing portion 113$A_{12}$ and the sheath pressing portion 113$B_1$. Thus, the boundary crimping area Tc is arranged to straddle the second core wire crimping portion 12$A_2$ and the sheath crimping portion 12B.

A part of the joining pressing area Tpj is included in the boundary pressing area Tpb. Accordingly, a part of the overlapping area Tol is included in the boundary crimping area Tc of the electric wire connection portion 12. Here, the boundary pressing area Tpb has a plurality of coupling pressing portions, which connect two pressing portions having different angles with respect to the drawing direction of the electric wire 50 from the crimp terminal 1 between the second core wire pressing portion 113$A_{12}$ side and the sheath pressing portion 113$B_1$ side, in at least the joining pressing area Tpj. Thus, the boundary crimping area Tc has a plurality of coupling crimping portions, which connect two crimping portions having different angles with respect to the drawing direction between the second core wire crimping portion 12$A_2$ side and the sheath crimping portion 12B side, in at least the overlapping area Tol. When the pair of barrel pieces (the first barrel piece 15 and the second barrel piece 16) is crimped by the first core wire pressing portion 113$A_{11}$, the sheath pressing portion 113$B_1$, and the second core wire pressing portion 113$A_{12}$ in the crimping step, the pair of the barrel pieces is crimped to the end of the electric wire 50 by the plurality of pressing portions provided in at least in the joining pressing area Tpj in the boundary pressing area Tpb, that is, the coupling pressing portions connecting the two pressing portions having different angles with respect to the drawing direction of the electric wire 50 from the crimp terminal 1 between the second core wire pressing portion 113$A_{12}$ side and the sheath pressing portion 113$B_1$ side.

Figure 17:
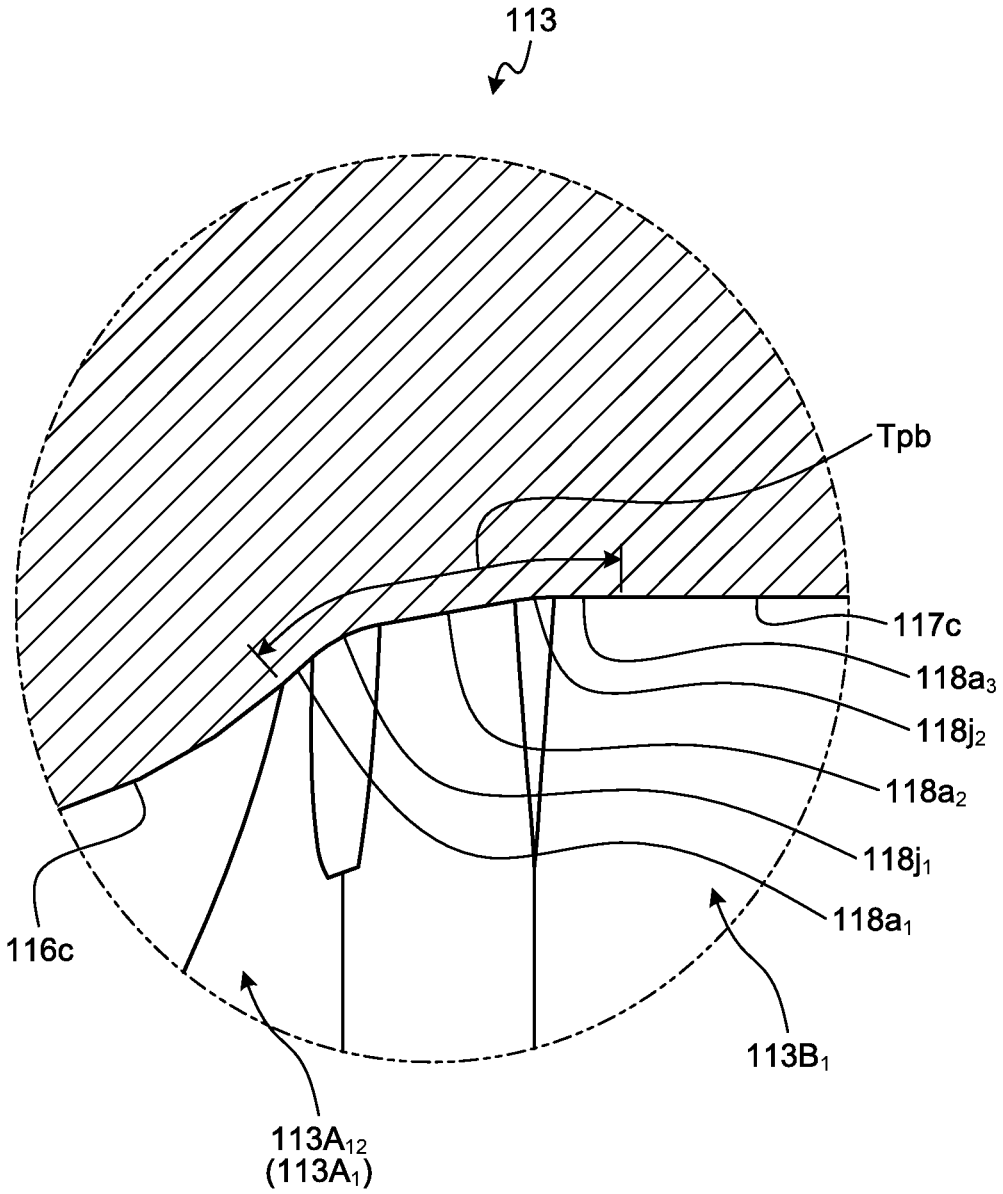
FIG. 17 is an enlarged view of a section C in FIG. 15.

In this example, a coupling pressing portion 118$j_1$ connecting a pressing portion 118$a_1$ on the second core wire pressing portion 113$A_{12}$ side and a pressing portion 118$a_2$ on the sheath pressing portion 113$B_1$ side, and a coupling pressing portion 118$j_2$ connecting the pressing portion 118$a_2$ on the second core wire pressing portion 113$A_{12}$ side and a pressing portion 118$a_3$ on the sheath pressing portion 113$B_1$ side are provided (FIG. 17). Therefore, a coupling crimping portion 19$j_1$ connecting a crimping portion 19$a_1$ on the second core wire crimping portion 12$A_2$ side and a crimping portion 19$a_2$ on the sheath crimping portion 12B side, and a coupling crimping portion 19$j_2$ connecting the crimping portion 19$a_2$ on the second core wire crimping portion 12$A_2$ side and a crimping portion 19$a_3$ on the sheath crimping portion 12B side are provided in the boundary crimping area Tc (FIGS. 3, 4, 9, 10, and 16). In the crimping step, the crimping portions 19$a_1$, 19$a_2$, and 19$a_3$ are formed by the pressing portions 118$a_1$, 118$a_2$, and 118$a_3$, respectively, and the coupling crimping portions 19$j_1$ and 19$j_2$ are formed by the coupling pressing portions 118$j_1$ and 118$j_2$, respectively. Here, the coupling crimping portions 19$j_1$ and 19$j_2$ are arranged not only in the overlapping area Tol but also in parts where the pair of barrel pieces is arranged to oppose the bottom 14 after completion of crimping. The respective coupling crimping portions 19$j_1$ and 19$j_2$ are eliminated while gradually changing toward side wall parts of the pair of barrel pieces after completion of crimping. Accordingly, here, the pressing portions 118$a_1$, 118$a_2$, and 118$a_3$ and the coupling pressing portions 118$j_1$ and 118$j_2$ are formed so as to form the above-described coupling crimping portions 19$j_1$ and 19$j_2$.

For example, the coupling crimping portion 19$j_1$ is formed in an arc shape that is gradually changed from the one crimping portion 19$a_1$ toward the other crimping portion 19$a_2$ so as to gently connect one crimping portion 19$a_1$ on the second core wire crimping portion 12$A_2$ side and the other crimping portion 19$a_2$ on the sheath crimping portion 12B side. In addition, the coupling crimping portion 19$j_2$ is formed in an arc shape that is gradually changed from the one crimping portion 19$a_2$ toward the other crimping portion 19$a_3$ so as to gently connect one crimping portion 19$a_2$ on the second core wire crimping portion 12$A_2$ side and the other crimping portion 19$a_3$ on the sheath crimping portion 12B side.

Figure 18:
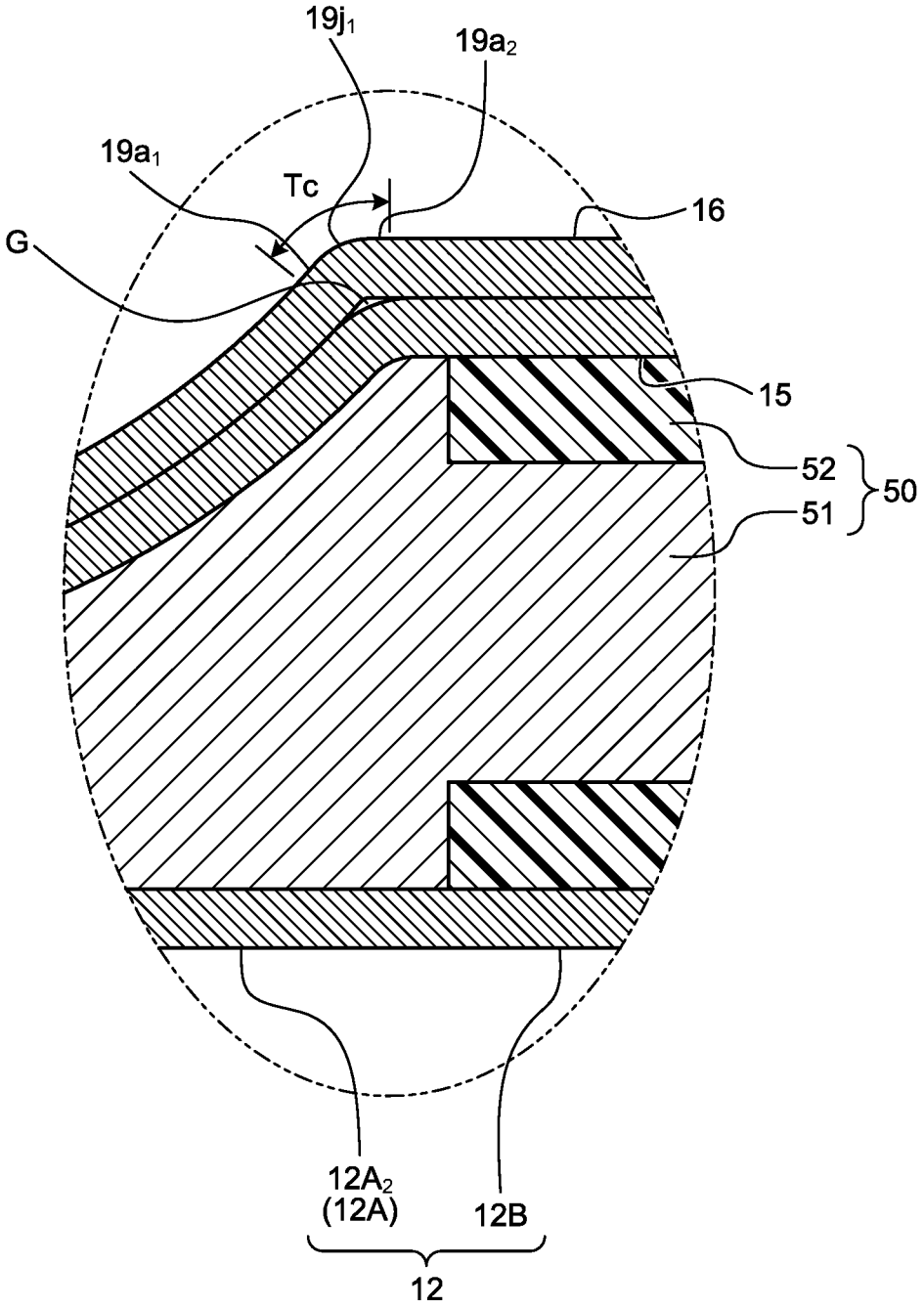
FIG. 18 is a cross-sectional view for describing a problem of the related art.

Here, in an electric wire connection portion 12 of the related art, two crimping portions 19$a_1$ and 19$a_2$ and one coupling crimping portion 19$j_1$ connecting these crimping portions 19$a_1$ and 19$a_2$ are formed in a boundary crimping area Tc after completion of crimping (FIG. 18). Accordingly, in this electric wire connection portion 12 of the related art, there is a possibility that a gap G is formed between the pair of barrel pieces (the first barrel piece 15 and the second barrel piece 16) in the overlapping area Tol of the coupling crimping portion 19$j_1$. On the other hand, in the electric wire connection portion 12 of the present embodiment, the three crimping portions 19$a_1$, 19$a_2$, and 19$a_3$ and the two coupling crimping portions 19$j_1$ and 19$j_2$ each of which connects adjacent crimping portions among these crimping portions 19$a_1$, 19$a_2$, and 19$a_3$ are formed in the boundary crimping area Tc after completion of crimping. Thus, the electric wire connection portion 12 of the present embodiment can achieve expansion of the boundary crimping area Tc between the second core wire crimping portion 12$A_2$ and the sheath crimping portion 12B as compared with that of the related art, and form the boundary crimping area Tc in a gentle shape. Therefore, the electric wire connection portion 12 of the present embodiment can reduce the gap G between the pair of barrel pieces or bring the pair of barrel pieces into close contact with each other in the overlapping area Tol in the boundary crimping area Tc as compared with that of the related art, and thus, can improve sealing performance.

In this manner, two-stage bent portions are formed in the boundary crimping area Tc after completion of crimping by the two coupling crimping portions 19$j_1$ and 19$j_2$. Although the two-stage bent portions have been exemplified here, when bent portions are formed in three stages, for example, it is possible to create the terminal-equipped electric wire 50A in which the three-stage bent portions are formed in the boundary crimping area Tc by forming the boundary pressing area Tpb of the second mold 113 as follows.

Figure 19:
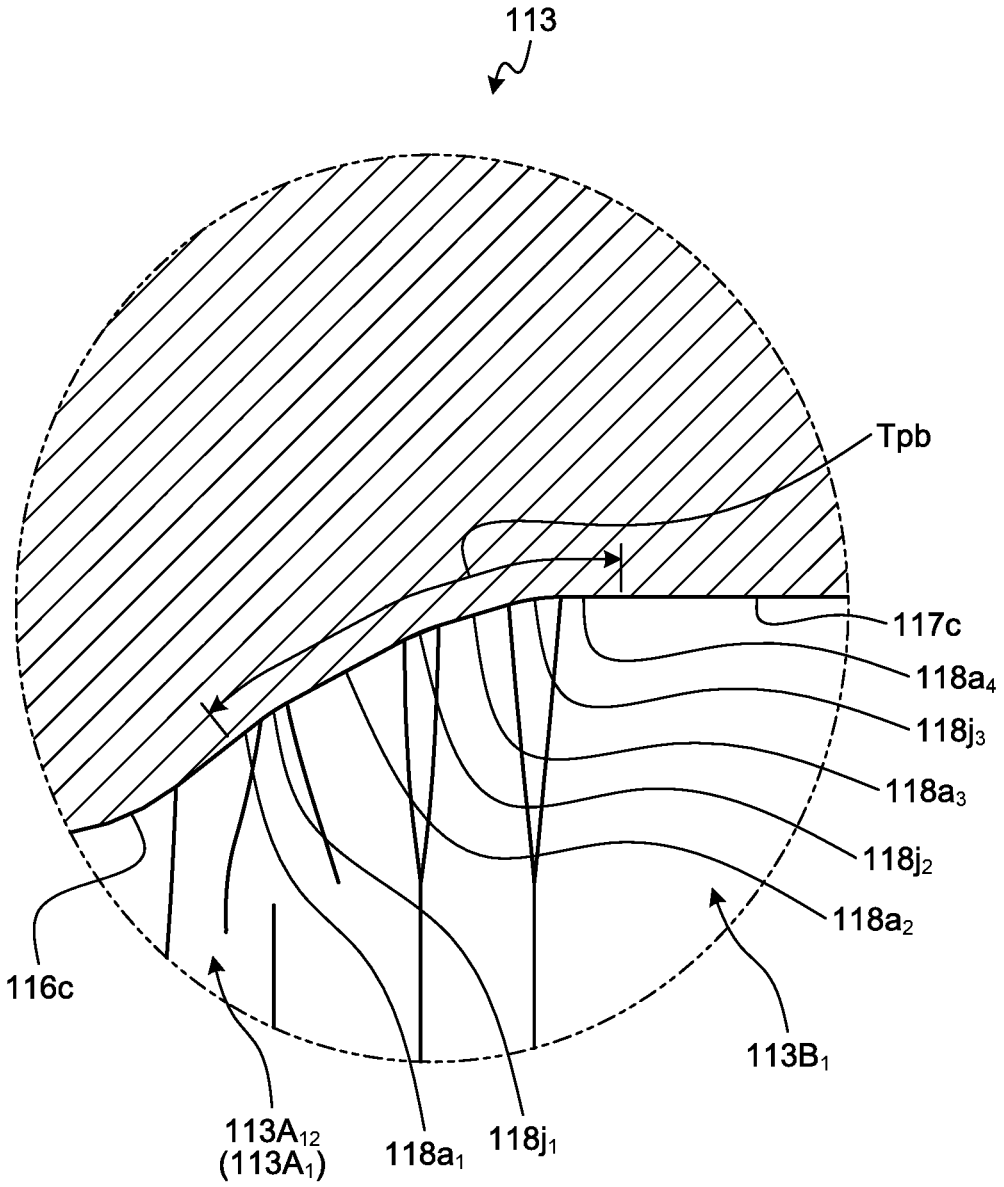
FIG. 19 is a cross-sectional view of the second mold corresponding to FIG. 17, and is a view for describing a modification of a boundary pressing area.
Figure 20:
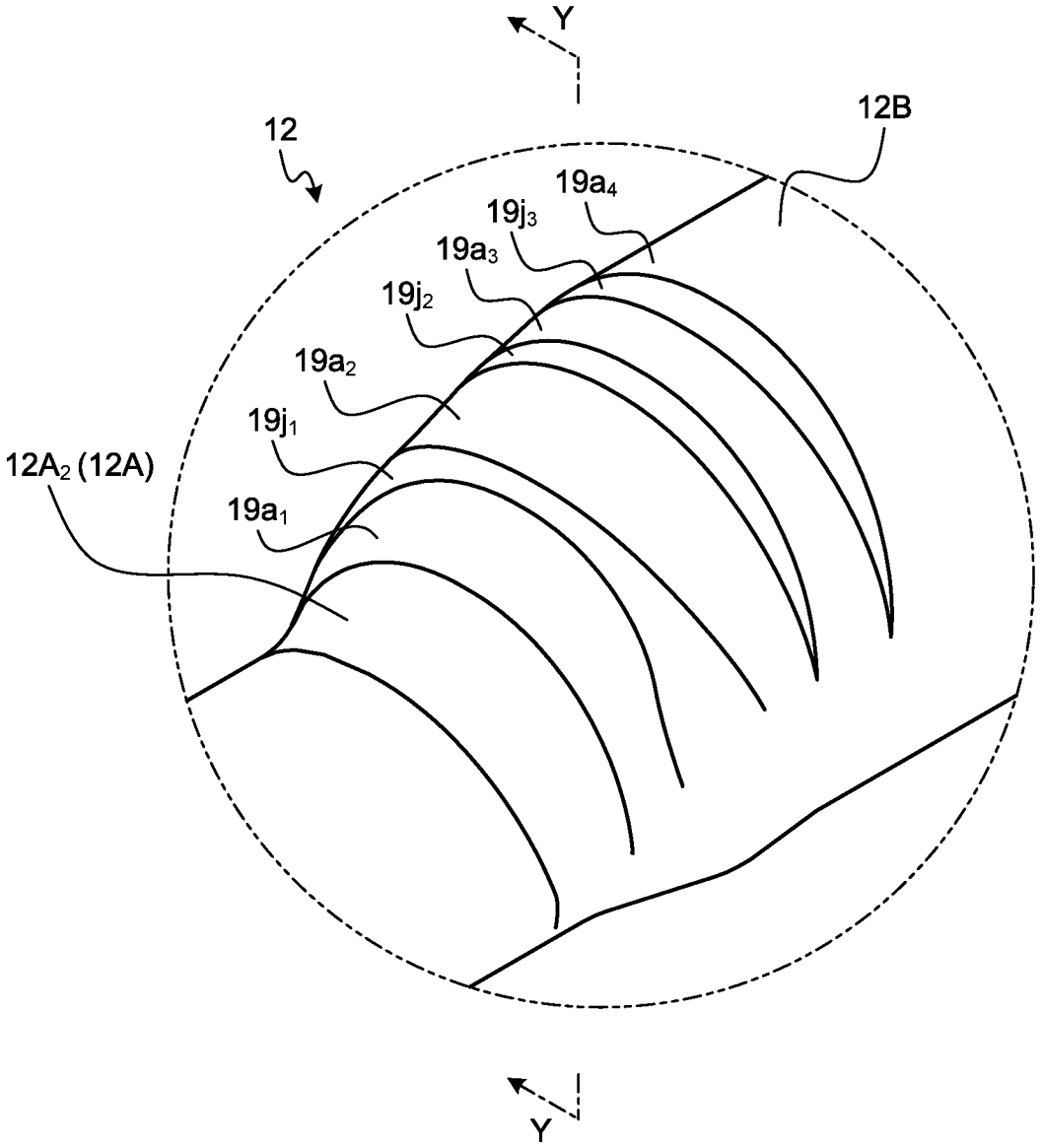
FIG. 20 is a perspective view of the terminal-equipped electric wire corresponding to FIG. 9, and is a view for describing a modification of the boundary crimping area.
Figure 21:
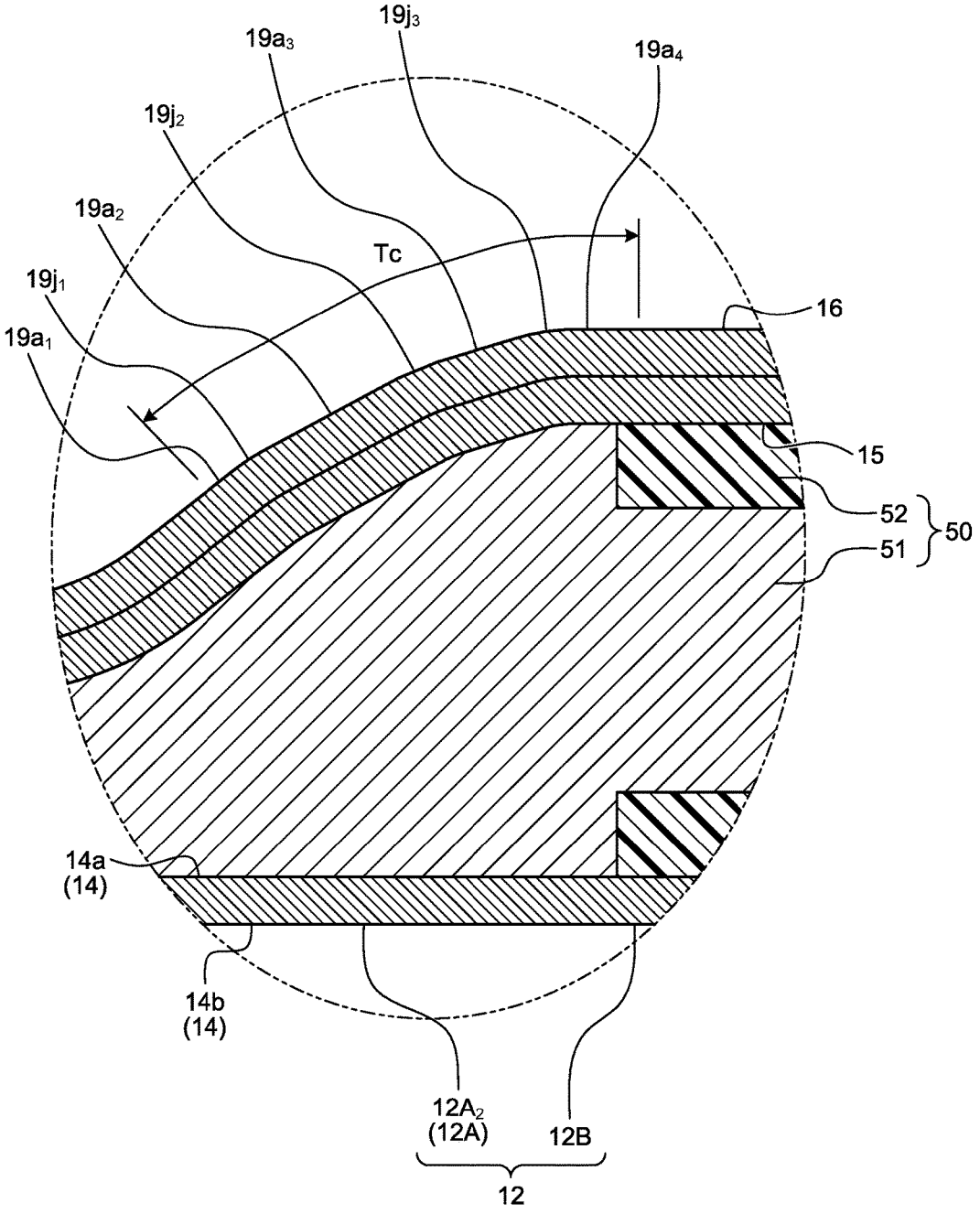
FIG. 21 is a cross-sectional view taken along a line Y-Y of FIG. 20.

Four pressing portions 118$a_1$, 118$a_2$, 118$a_3$, and 118$a_4$ and three coupling pressing portions 118$j_1$, 118$j_2$, and 118$j_3$ which connect adjacent ones of these pressing portions 118$a_1$, 118$a_2$, 118$a_3$, and 118$a_4$ are provided in the boundary pressing area Tpb (FIG. 19). The coupling pressing portion 118$j_1$ connects the pressing portion 118$a_1$ on the second core wire pressing portion 113$A_{12}$ side and the pressing portion 118$a_2$ on the sheath pressing portion 113$B_1$ side. The coupling pressing portion 118$j_2$ connects the pressing portion 118$a_2$ on the second core wire pressing portion 113$A_{12}$ side and the pressing portion 118$a_3$ on the sheath pressing portion 113$B_1$ side. The coupling pressing portion 118$j_3$ connects the pressing portion 118$a_3$ on the second core wire pressing portion 113$A_{12}$ side and the pressing portion 118$a_4$ on the sheath pressing portion 113$B_1$ side. Therefore, four crimping portions 19$a_1$, 19$a_2$, 19$a_3$, and 19$a_4$ and three coupling crimping portions 19$j_1$, 19$j_2$, and 19$j_3$ each of which connects adjacent crimping portions among these crimping portions 19$a_1$, 19$a_2$, 19$a_3$, and 19$a_4$ are formed in the boundary crimping area Tc (FIGS. 20 and 21). The coupling crimping portion 19$j_1$ connects the crimping portion 19$a_1$ on the second core wire crimping portion 12$A_2$ side and the crimping portion 19$a_2$ on the sheath crimping portion 12B side. The coupling crimping portion 19$j_2$ connects the crimping portion 19$a_2$ on the second core wire crimping portion 12$A_2$ side and the crimping portion 19$a_3$ on the sheath crimping portion 12B side. The coupling crimping portion 19$j_3$ connects the crimping portion 19$a_3$ on the second core wire crimping portion 12$A_2$ side and the crimping portion 19$a_4$ on the sheath crimping portion 12B side. In the crimping step, the crimping portions 19$a_1$, 19$a_2$, 19$a_3$, and 19$a_4$ are formed by the pressing portions 118$a_1$, 118$a_2$, 118$a_3$, and 118$a_4$, respectively, and the coupling crimping portions 19$j_1$, 19$j_2$, and 19$j_3$ are formed by the coupling pressing portions 118$j_1$, 118$j_2$, and 118$j_3$, respectively.

For example, the coupling crimping portion 19$j_1$ is formed in an arc shape that is gradually changed from the one crimping portion 19$a_1$ toward the other crimping portion 19$a_2$ so as to gently connect one crimping portion 19$a_1$ on the second core wire crimping portion 12$A_2$ side and the other crimping portion 19$a_2$ on the sheath crimping portion 12B side. In addition, the coupling crimping portion 19$j_2$ is formed in an arc shape that is gradually changed from the one crimping portion 19$a_2$ toward the other crimping portion 19$a_3$ so as to gently connect one crimping portion 19$a_2$ on the second core wire crimping portion 12$A_2$ side and the other crimping portion 19$a_3$ on the sheath crimping portion 12B side. In addition, the coupling crimping portion 19$j_3$ is formed in an arc shape that is gradually changed from the one crimping portion 19$a_3$ toward the other crimping portion 19$a_4$ so as to gently connect one crimping portion 19$a_3$ on the second core wire crimping portion 12$A_2$ side and the other crimping portion 19$a_4$ on the sheath crimping portion 12B side.

The electric wire connection portion 12 can achieve further expansion of the boundary crimping area Tc between the second core wire crimping portion 12$A_2$ and the sheath crimping portion 12B as compared with that having the two-stage bent portions, and form the boundary crimping area Tc in a gentler shape. Thus, the electric wire connection portion 12 can further reduce the gap G between the pair of barrel pieces or bring the pair of barrel pieces into close contact with each other in the overlapping area Tol in the boundary crimping area Tc as compared with that having the two-stage bent portions. Therefore, the electric wire connection portion 12 can further improve the sealing performance in the overlapping area Tol in the boundary crimping area Tc.

Figure 22:
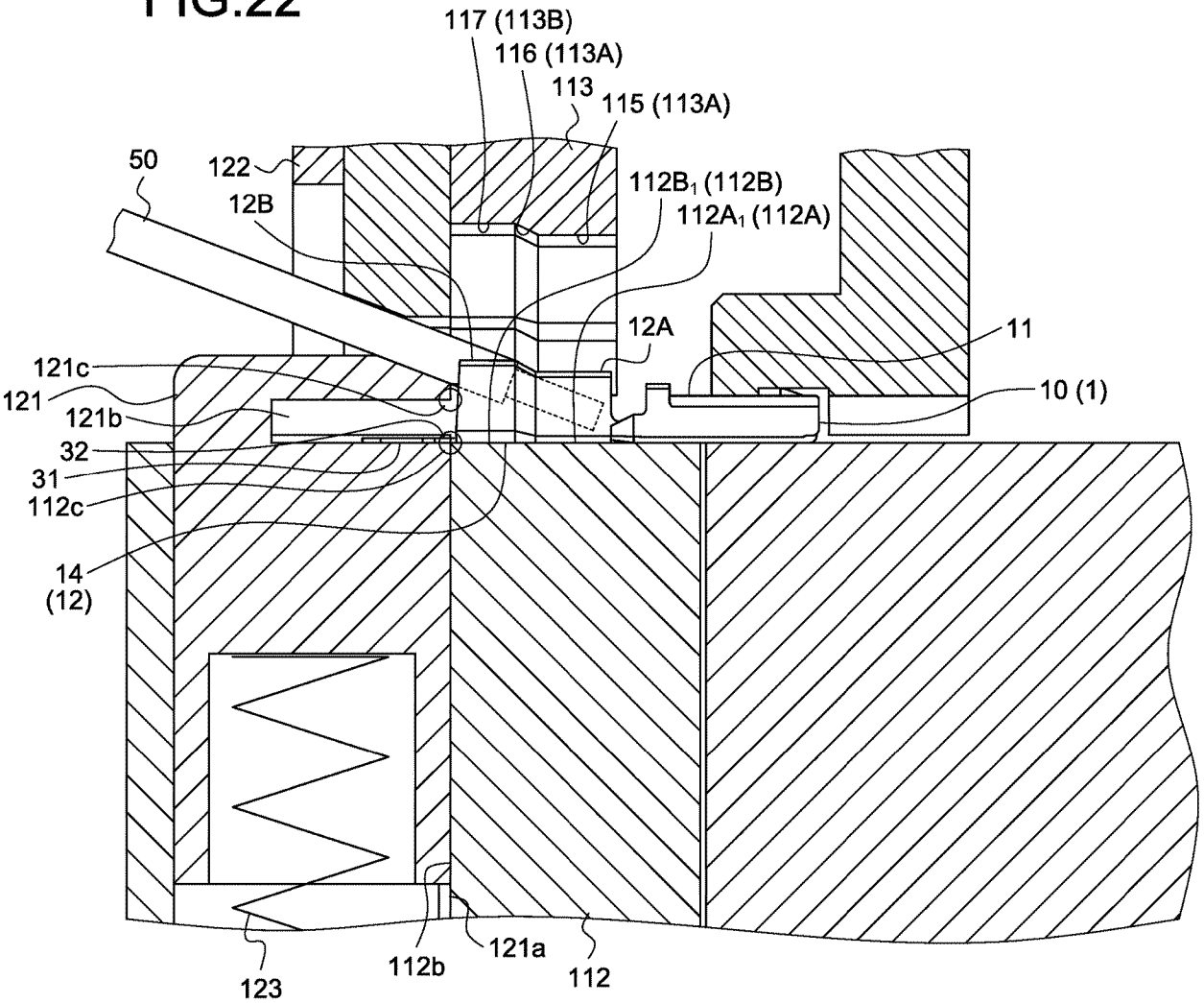
FIG. 22 is a diagram for describing a part of a crimping step.

The terminal cutting machine 120 is configured to sandwich the connecting portion 32 of the crimp terminal 1 supplied to the crimping position with two terminal cutting portions and cut the connecting portion 32. The terminal cutting machine 120 performs the separating of the crimp terminal 1 from the coupling piece 31 at the same time as the progression of the crimping processing. The terminal cutting machine 120 is arranged on the front side (the left side of the sheet plane of FIG. 12) of the second anvil 112B. The terminal cutting machine 120 is well known in this technical field and includes, for example, a terminal cutter 121, a pressing member 122, and an elastic member 123 (FIG. 22).

The terminal cutter 121 is formed in a rectangular parallelepiped shape and is arranged so as to be slidable in the vertical direction along a front surface (one end surface 112*b*) of the second anvil 112B. The terminal cutter 121 has a slide contact surface 121*a* that slides along the end surface 112*b* of the second anvil 112B. A slit 121*b* is formed inwardly from the slide contact surface 121*a* in the terminal cutter 121. The slit 121*b* is an internal space into which the coupling piece 31 is inserted in a state where a part of the connecting portion 32 connected to the crimp terminal 1 protrudes when the crimp terminal 1 to be crimped is supplied to the crimping position. Here, a position where the coupling piece 31 and the like can be inserted into the slit 121*b* is defined as an initial position of the terminal cutter 121 in the vertical direction. An end of the connecting portion 32 on the electric wire connection portion 12 side protrudes from the inside of the slit 121*b* through an opening of the slit 121*b* on the slide contact surface 121*a* side (that is, on the crimp terminal 1 side). In the terminal cutter 121, an upper edge (hereinafter referred to as an "opening edge") 121*c* of the opening is used as one terminal cutting portion.

The pressing member 122 is fixed to the ram 114A and vertically moves integrally with the ram 114A. The pressing member 122 is arranged above the terminal cutter 121 and descends to press down the terminal cutter 121. The pressing member 122 is formed in a rectangular parallelepiped shape. The elastic member 123 applies an upward biasing force to the terminal cutter 121, and is made of a spring member or the like. When a pressing force from the pressing member 122 is released, the elastic member 123 causes the terminal cutter 121 to return to the initial position in the vertical direction.

In the terminal cutting machine 120, the pressing member 122 descends along with the descending of the second mold 113 during the crimping processing, thereby pressing down the terminal cutter 121. As the terminal cutter 121 descends in the terminal cutting machine 120, the connecting portion 32 is sandwiched between the opening edge 121*c* of the slit 121*b* and an upper surface edge 112*c* (FIG. 22) as the other terminal cutting portion of the second anvil 112B. The opening edge 121*c* and the upper surface edge 112*c* act as scissors in the terminal cutting machine 120. Therefore, as the terminal cutter 121 is further pressed down in the terminal cutting machine 120, the connecting portion 32 is cut by the opening edge 121*c* and the upper surface edge 112*c*, and the crimp terminal 1 is separated from the terminal chain body 30.

As described above, in the terminal-equipped electric wire 50A, the terminal crimping apparatus 100, and the method of manufacturing a terminal-equipped electric wire of the present embodiment, the plurality of coupling crimping portions, which connect two crimping portions having the different angles between the second core wire crimping portion $12A_2$ side and the sheath crimping portion 12B side, are formed in at least the overlapping area Tol in the boundary crimping area Tc. That is, in the terminal-equipped electric wire 50A, the terminal crimping apparatus 100, and the method of manufacturing a terminal-equipped electric wire, the plurality of bent portions corresponding to the number of the plurality of coupling crimping portions are formed in the boundary crimping area Tc after completion of crimping. Accordingly, the terminal-equipped electric wire 50A, the terminal crimping apparatus 100, and the method of manufacturing a terminal-equipped electric wire of the present embodiment can form the boundary crimping area Tc in a gentle shape and reduce the gap G between the pair of barrel pieces or bring the pair of barrel pieces into close contact with each other in the overlapping area Tol in the boundary crimping area Tc. Therefore, the terminal-equipped electric wire 50A, the terminal crimping apparatus 100, and the method of manufacturing a terminal-equipped electric wire of the present embodiment can improve the sealing performance of the overlapping area Tol in the boundary crimping area Tc. In particular, when the crimp terminal 1 includes the above-described water stop member 20, the terminal-equipped electric wire 50A, the terminal crimping apparatus 100, and the method of manufacturing a terminal-equipped electric wire can further improve the sealing performance of the overlapping area Tol in the boundary crimping area Tc together with sealing performance of the water stop member 20 in the overlapping area Tol.

In the terminal-equipped electric wire, the terminal crimping apparatus, and the method of manufacturing a terminal-equipped electric wire according to the present embodiment, a plurality of coupling crimping portions, which connect two crimping portions having different angles between a second core wire crimping portion side and a sheath crimping portion side, are formed in at least an overlapping area in a boundary crimping area. That is, in the terminal-equipped electric wire, the terminal crimping apparatus, and the method of manufacturing a terminal-equipped electric wire, a plurality of bent portions corresponding to the number of the plurality of coupling crimping portions are formed in the boundary crimping area after completion of crimping. Accordingly, the terminal-equipped electric wire, the terminal crimping apparatus, and the method of manufacturing a terminal-equipped electric wire according to the present invention can form the boundary crimping area in a gentle shape and reduce a gap between the pair of barrel pieces or bring the pair of barrel pieces into close contact with each other in the overlapping area in the boundary crimping area. Therefore, the terminal-equipped electric wire, the terminal crimping apparatus, and the method of manufacturing a terminal-equipped electric wire according to the present invention can improve the sealing performance of the overlapping area in the boundary crimping area.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A terminal-equipped electric wire comprising:

an electric wire having a core wire bare at an end thereof; and a crimp terminal physically and electrically connected to the core wire by being crimped to the end of the electric wire, wherein the crimp terminal includes an electric wire connection portion in which a pair of barrel pieces is wound around the end of the electric wire placed on a bottom thereof to overlap each other, the electric wire connection portion includes a core wire crimping portion in which the bottom and the pair of barrel pieces are crimped to the core wire at the end of the electric wire, and a sheath crimping portion in which the bottom and the pair of barrel pieces are crimped to a sheath at the end of the electric wire, the electric wire connection portion is crimped to the end of the electric wire in a state where a distance between the bottom and the pair of barrel pieces in a sandwiching direction of the sheath in the sheath crimping portion is wider than a distance between the bottom and the pair of barrel pieces in a sandwiching direction of the core wire in the core wire crimping portion, the core wire crimping portion includes a first core wire crimping portion crimped to a distal end side of the core wire, and a second core wire crimping portion, in which the pair of barrel pieces is wound around the core wire while widening the distance with respect to the bottom in the sandwiching direction of the core wire as being directed from the first core wire crimping portion side to the sheath crimping portion side, between the first core wire crimping portion and the sheath crimping portion, the core wire crimping portion and the sheath crimping portion have an overlapping area in which one of the barrel pieces and the other barrel piece overlap each other, a boundary crimping area arranged at a boundary part between the second core wire crimping portion and the sheath crimping portion includes a plurality of coupling crimping portions, which connect two crimping portions having different angles with respect to a drawing direction of the electric wire from the crimp terminal between the second core wire crimping portion side and the sheath crimping portion side, in at least the overlapping area, and the pair of barrel pieces are together bending convexly toward outside at each coupling crimping portion.

2. The terminal-equipped electric wire according to claim 1, wherein the coupling crimping portion is formed in an arc shape that is gradually changed from the one of the crimping portions to the other crimping portion.

3. The terminal-equipped electric wire according to claim 1, wherein in each coupling crimping portion, an inner surface of one of the barrel pieces disposed inside with respect to the other of the barrel pieces bends convexly toward outside in the overlapping area.

4. The terminal-equipped electric wire according to claim 1, wherein, the coupling crimping portion closest to the sheath crimping portion among the plurality of coupling crimping portion is disposed at the end edge of the sheath.

5. A terminal crimping apparatus comprising:

a first mold that supports a bottom of a crimp terminal having the bottom and a pair of barrel pieces with a support surface; and a second mold that winds the pair of barrel pieces around an end of an electric wire to overlap each other while shortening a distance with respect to the first mold in a state where the end of the electric wire is inserted into a space surrounded by the bottom and the pair of barrel pieces, wherein the second mold includes a core wire pressing portion that crimps the pair of barrel pieces to a core wire bare at the end of the electric wire, and a sheath pressing portion that crimps the pair of barrel pieces to a sheath at the end of the electric wire, the core wire pressing portion and the sheath pressing portion are arranged such that a distance between the core pressing portion and the support surface in a relative movement direction between the first mold and the second mold is narrower than a distance between the sheath pressing portion and the support surface in the relative movement direction, the core wire pressing portion includes a first core wire pressing portion that crimps the pair of barrel pieces to a distal end side of the core wire; and a second core wire pressing portion that crimps the pair of barrel pieces to the core wire while widening a distance between the bottom and the pair of barrel pieces in a sandwiching direction of the core wire as being directed from the first core wire pressing portion side to the sheath pressing portion side, between the first core wire pressing portion and the sheath pressing portion, the core wire pressing portion and the sheath pressing portion have a joining pressing area to form an overlapping area in which one of the barrel pieces and the other barrel piece overlap each other, and a boundary pressing area arranged at a boundary part between the second core wire pressing portion and the sheath pressing portion includes a plurality of coupling pressing portions, which connect two pressing portions having different angles with respect to a drawing direction of the electric wire from the crimp terminal between the second core pressing portion side and the sheath pressing portion side, in at least the joining pressing area.

6. A method of manufacturing a terminal-equipped electric wire, the method comprising:

a terminal support step of supporting a bottom of a crimp terminal having the bottom and a pair of barrel pieces with a support surface of a first mold; and a crimping step of winding the pair of barrel pieces around an end of an electric wire to overlap each other while shortening a distance between the first mold and a second mold in a state where the end of the electric wire is inserted into a space surrounded by the bottom and the pair of barrel pieces to form a core wire crimping portion crimped to the core wire bare at the end of the electric wire and a sheath crimping portion crimped to a sheath at the end of the electric wire, wherein in the crimping step, the pair of barrel pieces is crimped to a distal end side of the core wire at the end of the electric wire by a first core wire pressing portion of the second mold arranged to oppose the support surface, the pair of barrel pieces is crimped to the sheath at the end of the electric wire by a sheath pressing portion of the second mold arranged to oppose the support surface, and the pair of barrel pieces is crimped to the core wire while widening a distance between the bottom and the pair of barrel pieces in a sandwiching direction of the core wire as being directed from the first core wire pressing portion side to the sheath pressing portion side by a second core wire pressing portion of the second mold arranged to oppose the support surface between the first core wire pressing portion and the sheath pressing portion, thereby forming an overlapping area in which one of the barrel pieces and the other barrel piece overlap each other, and in the crimping step, the pair of barrel pieces is crimped to the end of the electric wire by a plurality of pressing portions, provided in at least a joining pressing area to form the overlapping area in a boundary pressing area arranged at a boundary part between the second core wire pressing portion and the sheath pressing portion, that is, coupling pressing portions, which connect two pressing portions having different angles with respect to a drawing direction of the electric wire from the crimp terminal between the second core wire pressing portion side and the sheath pressing portion side, when crimping the pair of barrel pieces by the first core wire pressing portion, the sheath pressing portion, and the second core wire pressing portion.

* * * * *